US010451306B2

(12) United States Patent
Takenaka et al.

(10) Patent No.: US 10,451,306 B2
(45) Date of Patent: Oct. 22, 2019

(54) AIR-CONDITIONING APPARATUS

(71) Applicant: Mitsubishi Electric Corporation, Chiyoda-ku (JP)

(72) Inventors: Naofumi Takenaka, Chiyoda-ku (JP); Shinichi Wakamoto, Chiyoda-ku (JP); Yuji Motomura, Chiyoda-ku (JP); Osamu Morimoto, Chiyoda-ku (JP); Hirofumi Koge, Chiyoda-ku (JP); Koji Yamashita, Chiyoda-ku (JP)

(73) Assignee: Mitsubishi Electric Corporation, Chiyoda-ku (JP)

( * ) Notice: Subject to any disclaimer, the term of this patent is extended or adjusted under 35 U.S.C. 154(b) by 148 days.

(21) Appl. No.: 15/324,536

(22) PCT Filed: Jul. 28, 2015

(86) PCT No.: PCT/JP2015/071385
§ 371 (c)(1),
(2) Date: Jan. 6, 2017

(87) PCT Pub. No.: WO2016/017643
PCT Pub. Date: Feb. 4, 2016

(65) Prior Publication Data

US 2017/0198946 A1 Jul. 13, 2017

(30) Foreign Application Priority Data

Jul. 28, 2014 (JP) ..... 2014-153055

(51) Int. Cl.
*F24F 11/89* (2018.01)
*F25B 13/00* (2006.01)
(Continued)

(52) U.S. Cl.
CPC ..... *F24F 11/89* (2018.01); *F24F 11/36* (2018.01); *F25B 13/00* (2013.01); *F25B 41/04* (2013.01);
(Continued)

(58) Field of Classification Search
CPC .. F24F 11/89; F24F 11/36; F24F 3/065; F25B 49/005; F25B 41/04; F25B 13/00;
(Continued)

(56) References Cited

U.S. PATENT DOCUMENTS

2003/0213254 A1 11/2003 Koo
2013/0283843 A1 10/2013 Takenaka et al.
2015/0135756 A1 5/2015 Sakai et al.

FOREIGN PATENT DOCUMENTS

JP 2-140574 A 5/1990
JP 9-4940 A 1/1997
(Continued)

OTHER PUBLICATIONS

Kameyama et al., Air Conditioner, May 8, 2003, JP2003130482A, Whole Document (Year: 2003).*
(Continued)

*Primary Examiner* — Larry L Furdge
(74) *Attorney, Agent, or Firm* — Oblon, McClelland, Maier & Neustadt, L.L.P.

(57) ABSTRACT

An air-conditioning apparatus, including an outdoor unit including a compressor and an outdoor heat exchanger, a plurality of indoor units each including an indoor heat exchanger, and a relay unit configured to distribute refrigerant supplied from the outdoor unit to the plurality of indoor units, the relay unit including a first branch unit in which liquid-side pipes connected to the plurality of indoor units join together, and a refrigerant shutoff valve, which is configured to control bidirectional flow of the refrigerant,
(Continued)

and is provided to the first branch unit, the number of the refrigerant shut off valve being smaller than a number of the plurality of indoor units.

12 Claims, 22 Drawing Sheets

(51) Int. Cl.

| | |
|---|---|
| ***F25B 41/04*** | (2006.01) |
| ***F25B 49/00*** | (2006.01) |
| ***F24F 11/36*** | (2018.01) |
| *F24F 3/06* | (2006.01) |

(52) U.S. Cl.
CPC ..... *F25B 49/005* (2013.01); *F24F 3/065* (2013.01); *F25B 2313/0231* (2013.01); *F25B 2313/0233* (2013.01); *F25B 2313/02741* (2013.01); *F25B 2500/05* (2013.01); *F25B 2500/222* (2013.01); *F25B 2600/2519* (2013.01)

(58) Field of Classification Search
CPC ..... F25B 2500/05; F25B 2313/0233; F25B 2313/0231; F25B 2600/2519; F25B 2500/222; F25B 2313/02741
See application file for complete search history.

(56) References Cited

FOREIGN PATENT DOCUMENTS

| | | | | |
|---|---|---|---|---|
| JP | 2002-286325 | A | | 10/2002 |
| JP | 2003-130482 | A | | 5/2003 |
| JP | 2007212077 | A | * | 8/2007 |
| JP | 2009-299910 | A | | 12/2009 |
| JP | 2010-7998 | A | | 1/2010 |
| JP | 2012-57676 | A | | 3/2012 |
| WO | 2012/160598 | A1 | | 11/2012 |
| WO | 2012/164608 | A1 | | 12/2012 |
| WO | WO 2013/171783 | A1 | | 11/2013 |

OTHER PUBLICATIONS

Funada et al., Air Conditioner, Aug. 23, 2007, JP2007212077A, Whole Document (Year: 2007).*
Japanese Office Action dated Sep. 12. 2017 in Japanese Patent Application No. 2016-538367 (with unedited computer generated English translation).
Extended European Search Report dated Mar. 9, 2018 in European Patent Application No. 15827893.7, 6 pages.
Combined Office Action and Search Report dated Aug. 22, 2018 in Chinese Patent Application No. 201580040525.0 (with English translation and English translation of category of cited documents).
International Search Report dated Oct. 20, 2015 in PCT/JP2015/071385 filed Jul. 28, 2015.

* cited by examiner

AIR-CONDITIONING APPARATUS

TECHNICAL FIELD

The present invention relates to an air-conditioning apparatus including a refrigeration cycle.

BACKGROUND ART

An air-conditioning apparatus includes, for example, a refrigerant circuit including an outdoor unit being a heat source unit arranged outside a building and an indoor unit arranged inside the building, which are connected to each other by a pipe, and refrigerant circulates through the refrigerant circuit (see, for example, Patent Literatures 1 to 4). Further, in the air-conditioning apparatus, air in a space to be air-conditioned is heated or cooled by using heat rejection from or heat removal by the refrigerant so as to heat or cool the space to be air-conditioned. Here, for example, when the refrigerant is leaked from the indoor unit arranged in an indoor space for some reason, the leakage poses an remarkably serious problem in view of, for example, effects on a human body and safety in a case where the refrigerant is of kind having inflammability, toxicity, or other characteristics. Further, even when the leaked refrigerant is, for example, harmless to the human body, there is a fear in that the refrigerant leaked in the indoor space may increase a concentration of the refrigerant to lower an oxygen concentration in the indoor space to result in adverse effects on the human body. A multi-air-conditioning apparatus including a plurality of the indoor units, in which the pipe configured to connect the outdoor unit and the indoor units ranges up to 100 meters, is filled with a large amount of the refrigerant. Therefore, countermeasures to prevent the leakage of the refrigerant are particularly needed.

Therefore, there has been proposed an air-conditioning apparatus including a refrigerant sensor and a pipe shutoff valve. In the air-conditioning apparatus, when the leakage of the refrigerant is detected by the refrigerant sensor, the leakage of the refrigerant is displayed on a remote controller. In this manner, a person who is present indoors can be informed of the leakage of the refrigerant. Further, when the leakage of the refrigerant is detected, a control unit of the air-conditioning apparatus closes the pipe shutoff valve. As a result, the amount of refrigerant leaked indoors can be reduced.

In Patent Literature 1, there is disclosed an air-conditioning apparatus using carbon dioxide ($CO_2$) as the refrigerant. In Patent Literature 1, when a $CO_2$ sensor installed indoors detects a predetermined amount of $CO_2$, a solenoid valve installed in a gas pipe of the indoor unit is closed, while a solenoid valve configured to control a flow rate of $CO_2$, which is installed in a liquid pipe of the indoor unit, is closed. Further, leakage of $CO_2$ is displayed on a remote controller that is present indoors.

In Patent Literature 2, there is disclosed a multi-air-conditioning apparatus capable of performing a cooling and heating mixed operation. In the cooling and heating mixed operation, when the indoor unit performing a heating operation is stopped, hot gas refrigerant flowing through the indoor unit passes through a flow control valve to return to the indoor unit performing a cooling operation. As a result, the refrigerant is heated to lower cooling capacity in the indoor unit. Patent Literature 2 is intended to solve the problem described above by using the solenoid valve provided in a branch unit at which liquid pipes connected to the plurality of indoor units join together.

In Patent Literature 3, there is disclosed a refrigerant shutoff valve that is available in a fluid circuit in which a fluid flows bi-directionally and is capable of appropriately preventing passage of the fluid in a specific direction. A specific structure thereof is disclosed therein.

In Patent Literature 4, there is described a multi-air-conditioning apparatus including a relay device (branch device) in which the liquid pipes and the gas pipes connected to the plurality of indoor units join together. In Patent Literature 4, the relay device includes shutoff valves provided respectively for the liquid pipes and shutoff valves provided respectively for the gas pipes. Then, by using each of the shutoff valves respectively for the liquid pipe and the gas pipe connected to the indoor unit into which the refrigerant is leaked, the refrigerant is prevented from flowing from an other indoor unit or other units into the indoor unit in which the refrigerant is leaked.

CITATION LIST

Patent Literature

Patent Literature 1: Japanese Unexamined Patent Application Publication No. 2010-7998 (FIG. 1)

Patent Literature 2: Japanese Unexamined Patent Application Publication No. Hei 9-4940 (FIG. 1)

Patent Literature 3: Japanese Unexamined Patent Application Publication No. 2012-57676 (FIG. 1)

Patent Literature 4: WO 2012/160598 A1 (FIG. 2)

SUMMARY OF INVENTION

Technical Problem

The flow control valve configured to control the flow rate has a passage resistance that is continuously changed by moving a needle up and down. As described in Patent Literature 2, however, the flow control valve cannot be fully closed even in a fully closed state, but is slightly open. Therefore, the refrigerant cannot be completely shut off.

The air-conditioning apparatus disclosed in Patent Literature 1 closes the solenoid valve provided in a liquid-side pipe connected to the indoor unit into which the refrigerant is leaked so as to prevent the refrigerant in the entire circuit from flowing into the indoor unit in which the leakage occurs. As described above, however, the solenoid valve cannot be fully closed. Therefore, the refrigerant continues flowing into the indoor unit in which the leakage occurs. Further, in a gas-side pipe, the solenoid valve is closed to prevent the refrigerant in the entire circuit from flowing into the indoor unit in which the leakage occurs. However, when a pressure is applied approximately in a direction opposite to a designed direction, the solenoid valve does not operate normally. For example, in the cooling operation, the refrigerant flows from the indoor unit to the outdoor unit. Therefore, the solenoid valve is mounted to the gas-side pipe for a normal operation in a state in which a pressure on the indoor unit side is high. When the refrigerant is leaked, however, the pressure in the indoor unit into which the refrigerant is leaked is lowered to an atmospheric pressure. Therefore, the pressure is applied in the direction opposite to the designed direction, and hence the solenoid valve does not operate normally. Thus, the refrigerant cannot be shut off.

In the gas-side pipe, when the refrigerant shutoff valve disclosed in Patent Literature 3, specifically, the refrigerant shutoff valve that is available in the fluid circuit in which the fluid flows bi-directionally and is capable of appropriately preventing the passage of the fluid in the specific direction is used, the inflow of the refrigerant can be blocked. In the liquid-side pipe, however, the problem still remains unsolved.

Further, the air-conditioning apparatus disclosed in Patent Literature 4 requires two shutoff valves for each indoor unit. As a result, cost increases, and the number of actuators to be controlled is increased to complicate control.

The present invention has been made in the context of the above-mentioned problems, and provides an air-conditioning apparatus that reduces the number of refrigerant shutoff valves to be used so as to suppress a cost rise and complication of control.

Solution to Problem

According to one embodiment of the present invention, there is provided an air-conditioning apparatus, including: an outdoor unit including a compressor and an outdoor heat exchanger; a plurality of indoor units each including an indoor heat exchanger; and a relay unit configured to distribute refrigerant supplied from the outdoor unit to the plurality of indoor units, the relay unit including a first branch unit in which liquid-side pipes connected to the plurality of indoor units join together, and a refrigerant shutoff valve, which is configured to control bidirectional flow of the refrigerant, and is provided to the first branch unit, a number of the refrigerant shut off valve being smaller than a number of the plurality of indoor units.

Advantageous Effects of Invention

According to the present invention, the number of refrigerant shutoff valves, each being connected to the liquid-side pipe connected to the indoor units, smaller than the number of indoor units, is provided. Therefore, cost reduction and simplification of control can be both achieved.

DESCRIPTION OF EMBODIMENTS

Figure 1:
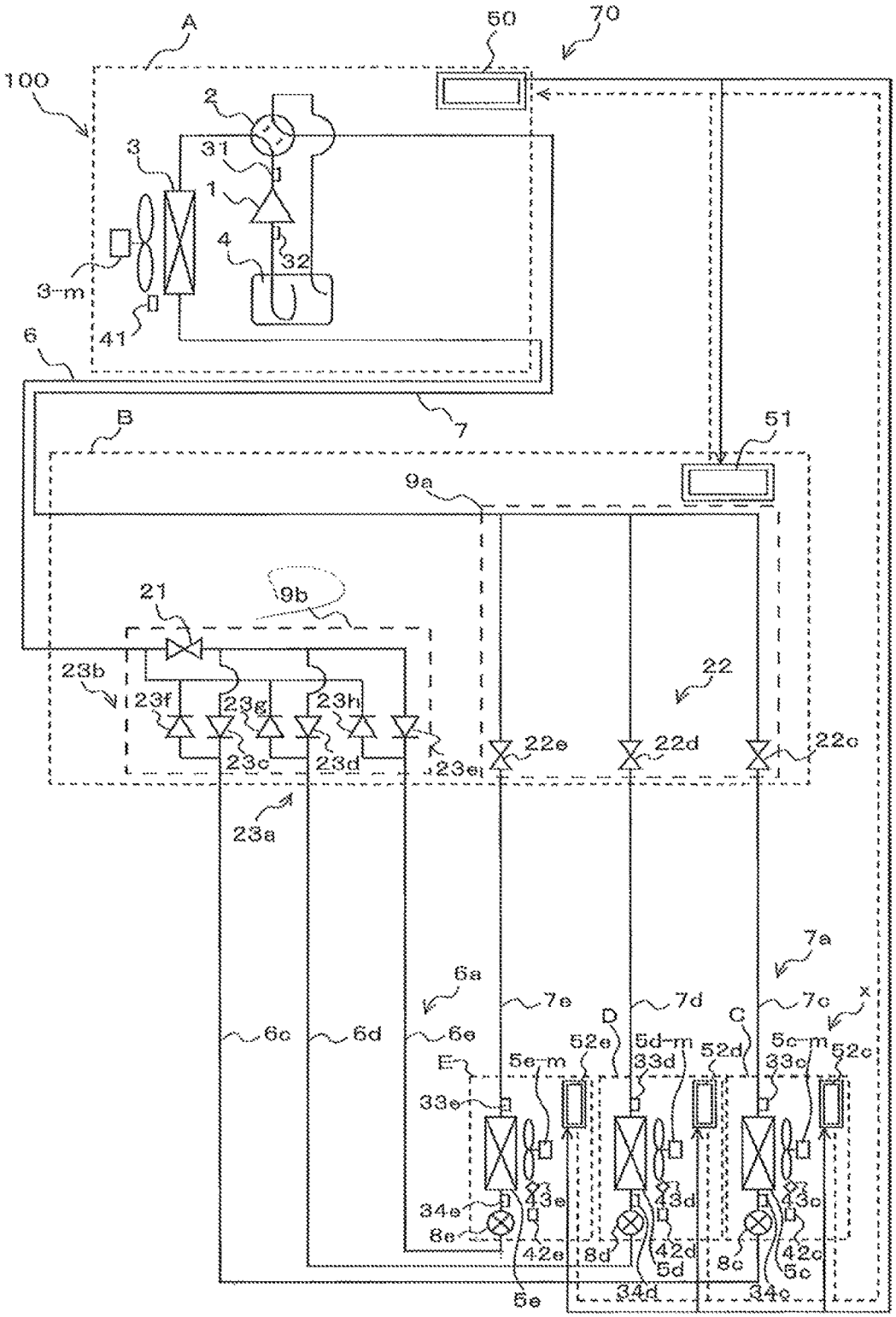
FIG. 1 is a circuit diagram for illustrating an air-conditioning apparatus 100 according to Embodiment 1 of the present invention.

Now, embodiments of the present invention are described with reference to the drawings. The present invention is not limited to the embodiments described below. Further, in the drawings referred to below, the size relationship between components may be different from the reality in some cases.

Embodiment 1

FIG. 1 is a circuit diagram for illustrating an air-conditioning apparatus 100 according to Embodiment 1 of the present invention. With reference to FIG. 1, the air-conditioning apparatus 100 is described. As illustrated in FIG. 1, the air conditioning apparatus 100 includes an outdoor unit A (heat source unit), a plurality of indoor units X connected in parallel to each other, and a relay unit B interposed between the outdoor unit A and the indoor units X, thereby forming a refrigeration cycle. The three indoor units X are provided, and correspond to a first indoor unit C, a second indoor unit D, and a third indoor unit E. In Embodiment 1, the one outdoor unit A, the one relay unit B, and the three indoor units X are provided. However, the number of outdoor units A, the number of relay units B, and the number of indoor units X to be connected are not limited to those described above. For example, two or more outdoor units A, two or more relay units B, and two or more indoor units X to be connected in parallel may be provided.

The outdoor unit A and the relay unit B are connected to each other by a first connecting pipe 6 and a second connecting pipe 7. The first connecting pipe 6 serves as a liquid-side pipe through which liquid refrigerant flows, whereas the second connecting pipe 7 serves as a gas-side pipe through which gas refrigerant flows.

Further, the relay unit B and the indoor units X are connected to each other by first indoor unit-side connecting pipes 6*a* and second indoor unit-side connecting pipes 7*a*. The first indoor unit-side connecting pipes 6*a* serve as liquid-side pipes through which the liquid refrigerant flows, whereas the second indoor unit-side connecting pipes 7*a* serve as gas-side pipes through which the gas refrigerant flows. An eleventh indoor unit-side connecting pipe 6*c* and a twenty-first indoor unit-side connecting pipe 7*c* are connected to the first indoor unit C. A twelfth indoor unit-side connecting pipe 6*d* and a twenty-second indoor unit-side connecting pipe 7*d* are connected to the second indoor unit D. A thirteenth indoor unit-side connecting pipe 6*e* and a twenty-third indoor unit-side connecting pipe 7*e* are connected to the third indoor unit E.

As the refrigerant to be used in the refrigeration cycle constructing the air-conditioning apparatus 100, chlorofluorocarbon refrigerant, such as R32, R125, and R134a, each being HFC-based refrigerant, or R410a, R407c, R404A, and other refrigerants, each being a refrigerant mixture thereof, can be used. Further, the refrigerant may be HFO refrigerant such as HFO-1234yf, HFO-1234ze (E), and HFO-1234ze (Z), $CO_2$ refrigerant, HC refrigerant (for example, propane refrigerant, isobutane refrigerant), ammonium refrigerant, or a refrigerant mixture of the above-mentioned refrigerant, such as a refrigerant mixture of R32 and HFO-1234yf. As described above, refrigerant to be used for a vapor-compression type heat pump only needs to be used as the refrigerant.

(Outdoor Unit A)

The outdoor unit A is normally installed in a space outside of a building such as an office building, for example, on a rooftop or other locations, and is configured to supply cooling energy or heating energy to the indoor units X through the relay unit B. A location where the outdoor unit A is installed is not limited to outdoor, and may be a surrounded space, for example, a machine room having an air vent, and therefore may also be inside the building as long as waste heat can be exhausted out of the building by an exhaust duct.

The outdoor unit A includes a compressor 1 configured to compress the refrigerant, a flow switching unit 2 constructed of a four-way valve configured to switch a flow direction of the refrigerant, an outdoor heat exchanger 3 configured to allow heat exchange between a fluid and the refrigerant, an accumulator 4 configured to store liquid refrigerant therein, and an outdoor control unit 50. The compressor 1, the flow switching unit 2, the outdoor heat exchanger 3, and the accumulator 4 are connected by the first connecting pipe 6 and the second connecting pipe 7. Further, in the vicinity of the outdoor heat exchanger 3, an outdoor air-sending device 3*m* being a flow control unit configured to control a flow rate of the fluid that exchanges heat with the refrigerant is provided.

The compressor 1 is configured to suck and compress the refrigerant into a high-temperature and high-pressure state, and can be constructed of, for example, a capacity controllable inverter compressor or other components. Further, the flow switching unit 2 is configured to perform switching between a direction of flow of the refrigerant during a heating operation and a direction of flow of the refrigerant during a cooling operation. The outdoor heat exchanger 3 functions as an evaporator during the heating operation and functions as a condenser or a radiator during the cooling operation. Further, the outdoor heat exchanger 3 allows heat exchange between the fluid (for example, air) supplied from the outdoor air-sending device 3*m* and the refrigerant to evaporate and gasify or condense and liquefy the refrigerant. The accumulator 4 is provided on a suction side of the compressor 1, and is configured to accumulate surplus refrigerant generated due to a difference between the amount of flow of the refrigerant during the heating operation and the amount of flow of the refrigerant during the cooling operation and to accumulate surplus refrigerant generated due to a transient change in operation.

Further, a discharge-pressure detecting unit 31 is provided to a pipe on a discharge side of the compressor 1, whereas a suction-pressure detecting unit 32 is provided to a pipe on the suction side of the compressor 1. Further, an outdoor-temperature detecting unit 41 is provided in the vicinity of the outdoor heat exchanger 3. Further, the outdoor control unit 50 is configured to control each of configurations of the air-conditioning apparatus 100 based on pressure information and temperature information detected by the discharge-pressure detecting unit 31, the suction-pressure detecting unit 32, and the outdoor-temperature detecting unit 41.

(Relay Unit B)

The relay unit B is installed, for example, outside of the building or inside of the building, e.g., above a ceiling, which is a space different from the indoor space, and is configured to distribute the cooling energy or the heating energy supplied from the outdoor unit A to the indoor units X. Besides, the relay unit B may be installed in a common space or other spaces in which an elevator or other facilities are installed.

The relay unit B includes, as a branch point of the refrigerant, a first branch unit 9*b* to be connected to the first connecting pipe 6 of the outdoor unit A, specifically, the liquid-side pipe, a second branch unit 9*a* to be connected to the second connecting pipe 7 of the outdoor unit A, specifically, the gas-side pipe, and a relay control unit 51. Further, in the first branch unit 9*b*, the first indoor unit-side connecting pipes 6*a*, specifically, the liquid-side pipes connected to the plurality of indoor units X join together. Further, in the second branch unit 9*a*, the second indoor unit-side connecting pipes 7*a*, specifically, the gas-side pipes connected to the plurality of indoor units X join together.

The first branch unit 9*b* of the relay unit B includes the number of first refrigerant shutoff valves 21, each being configured to control bi-directional flow of the refrigerant, which is smaller than the number of the plurality of indoor units X. In Embodiment 1, the number of first refrigerant shutoff valve 21 provided in the first branch unit 9*b* is one. The first branch unit 9*b* includes a path configured to allow the flow of the refrigerant from the indoor units X to the relay unit B and a path configured to allow the flow of the refrigerant from the relay unit B to the indoor units X. The first relay shutoff valve 21 is provided in the path configured to allow the flow of the refrigerant from the relay unit B to the indoor units X, on upstream of branch points at which the path branches to the plurality of indoor units X.

Further, the first branch unit 9*b* of the relay unit B includes parallel check valves 23*b* arranged in parallel to the first refrigerant shutoff valve 21, configured to allow the flow of the refrigerant from the indoor units X to the relay unit B, and series check valves 23*a* arranged in series with the first refrigerant shutoff valve 21, configured to allow the flow of the refrigerant from the relay unit B to the indoor units X. The "parallel check valves 23*b*" is a collective designation, and includes a first parallel check valve 23*f* provided to the eleventh indoor unit-side connecting pipe 6*c*, a second parallel check valve 23*g* provided to the twelfth indoor unit-side connecting pipe 6*d*, and a third parallel check valve 23*h* provided to the thirteenth indoor unit-side connecting pipe 6*e*. Meanwhile, the "series check valves 23*a*" is a collective designation, and includes a first series check valve 23*c* provided to the eleventh indoor unit-side connecting pipe 6*c*, a second series check valve 23*d* provided to the twelfth indoor unit-side connecting pipe 6*d*, and a third series check valve 23*e* provided to the thirteenth indoor unit-side connecting pipe 6*e*.

The relay unit B includes second refrigerant shutoff valves 22 configured to control the bi-directional flow of the refrigerant. The refrigerants flowing out of the second refrigerant shutoff valves 22 join together in the second branch unit 9*a*. The "second refrigerant shutoff valves 22" is a collective designation, and includes a twenty-first refrigerant shutoff valve 22*c* provided to the twenty-first indoor unit-side connecting pipe 7*c*, a twenty-second refrigerant shutoff valve 22*d* provided to the twenty-second indoor unit-side connecting pipe 7*d*, and a twenty-third refrigerant shutoff valve 22*e* provided to the twenty-third indoor unit-side connecting pipe 7*e*.

The relay control unit 51 is configured to control opening and closing operations of the first refrigerant shutoff valve 21 and the second refrigerant shutoff valves 22.

(Indoor Units X)

The indoor units X are installed at a location where conditioned-air can be supplied to a space to be air-conditioned such as an indoor space, and are configured to supply cooling air or heating air to the space to be air-conditioned by the cooling energy or the heating energy distributed from the outdoor unit A through the relay unit B.

Each of the indoor units X includes an indoor heat exchanger 5 configured to allow heat exchange between the fluid and the refrigerant, an indoor expansion unit 8 configured to reduce the refrigerant in pressure and expand the refrigerant, and an indoor control unit 52. The indoor expansion units 8 and the first branch unit 9*b* are connected by the first indoor unit-side connecting pipes 6*a*. Further, the indoor heat exchangers 5 and the second branch unit 9*a* are connected by the second indoor unit-side connecting pipes 7*a*. Further, in the vicinity of each of the indoor heat exchangers 5, an indoor air-sending device 5*a* being a flow control unit configured to control a flow rate of the fluid that exchanges heat with the refrigerant is provided. Each of the indoor heat exchangers 5 functions as a condenser during the heating operation and functions as an evaporator during the cooling operation. Further, the indoor heat exchangers 5 are configured to allow heat exchange between a fluid supplied from the indoor air-sending device 5*a*, for example, air and the refrigerant to condense and liquefy or evaporate and gasify the refrigerant.

The "indoor heat exchangers 5" is a collective designation, and includes a first indoor heat exchanger 5*c* provided to the first indoor unit C, a second indoor heat exchanger 5*d* provided to the second indoor unit D, and a third indoor heat exchanger 5*e* provided to the third indoor unit E. Further, the "indoor expansion units 8" is a collective designation, and includes a first indoor expansion unit 8*c* provided to the first indoor unit C, a second indoor expansion unit 8*d* provided to the second indoor unit D, and a third indoor expansion unit 8*e* provided to the third indoor unit E. Further, the "indoor air-sending devices 5*a*" is a collective designation, and includes a first indoor air-sending device 5*cm* provided to the first indoor unit C, a second indoor air-sending device 5*dm* provided to the second indoor unit D, and a third indoor air-sending device 5*em* provided to the third indoor unit E.

Further, first indoor unit temperature detecting units 34 are provided to the first indoor unit-side connecting pipes 6*a*, whereas second indoor unit temperature detecting units 33 are provided to the second indoor unit-side connecting pipes 7*a*. Further, indoor-temperature detecting units 42 are provided in the vicinity of the indoor heat exchangers 5. The indoor control units 52 are configured to control each of configurations of the air-conditioning apparatus 100 based on temperature information detected by the first indoor unit temperature detecting units 34, the second indoor unit temperature detecting units 33, and the indoor-temperature detecting units 42. Still further, refrigerant leakage detecting units 43 configured to detect leakage of the refrigerant are provided in the vicinity of air-suction ports or air-discharge ports of the indoor heat exchangers 5. The refrigerant leakage detecting units 43 are, for example, refrigerant concentration detecting units, which are configured to detect a refrigerant concentration in the air, and are configured to determine the leakage of the refrigerant when a refrigerant concentration in the air exceeds a predetermined threshold value.

The "first indoor unit temperature detecting units 34" is a collective designation, and includes an eleventh indoor unit temperature detecting unit 34*c* provided to the eleventh indoor unit-side connecting pipe 6*c*, a twelfth indoor unit temperature detecting unit 34*d* provided to the twelfth indoor unit-side connecting pipe 6*d*, and a thirteenth indoor unit temperature detecting unit 34*e* provided to the thirteenth indoor unit-side connecting pipe 6*e*. Further, the "second indoor unit temperature detecting units 33" is a collective designation, and includes a twenty-first indoor unit temperature detecting unit 33*c* provided to the twenty-first indoor unit-side connecting pipe 7*c*, a twenty-second indoor unit temperature detecting unit 33*d* provided to the twenty-second indoor unit-side connecting pipe 7*d*, and a twenty-third indoor unit temperature detecting unit 33*e* provided to the twenty-third indoor unit-side connecting pipe 7*e*.

The "indoor-temperature detecting units 42" is a collective designation, and includes a first indoor-temperature detecting unit 42*c* provided in the vicinity of the first indoor heat exchanger 5*c*, a second indoor-temperature detecting unit 42*d* provided in the vicinity of the second indoor heat exchanger 5*d*, and a third indoor-temperature detecting unit 42*e* provided in the vicinity of the third indoor heat exchanger 5*e*. Further, the "indoor control units 52" is a collective designation, and includes a first indoor control unit 52*c* provided to the first indoor unit C, a second indoor control unit 52*d* provided to the second indoor unit D, and a third indoor control unit 52*e* provided to the third indoor unit E. Further, the "refrigerant leakage detecting units 43" is a collective designation, and includes a first refrigerant leakage detecting unit 43*c* provided in the vicinity of the first indoor heat exchanger 5*c*, a second refrigerant leakage detecting unit 43*d* provided in the vicinity of the second indoor heat exchanger 5*d*, and a third refrigerant leakage detecting unit 43*e* provided in the vicinity of the third indoor heat exchanger 5*e*.

Next, the control unit 70 is described. The control unit 70 includes the outdoor control unit 50, the relay control unit 51, and the indoor control units 52. When the refrigerant leakage detecting units 43 detect the leakage of the refrigerant in at least one of the plurality of indoor units X, the control unit 70 is configured to control the flow switching unit 2 so that the outdoor heat exchanger 3 serves as a passage functioning as the condenser.

Next, an operation of the air-conditioning apparatus 10 according to Embodiment 1 is described. As an operation mode of the air-conditioning apparatus 100, two modes respectively for the cooling operation and the heating operation are mounted. During the cooling operation, only the cooling operation is performed by the indoor units X. Therefore, the indoor units X perform the cooling operation or are stopped. During the heating operation, only the heating operation is performed by the indoor units X. Therefore, the indoor units X perform the heating operation or are stopped. Operations during the cooling operation or the heating operation are described with reference to a P-h diagram.

(Cooling Operation)

Figure 2:
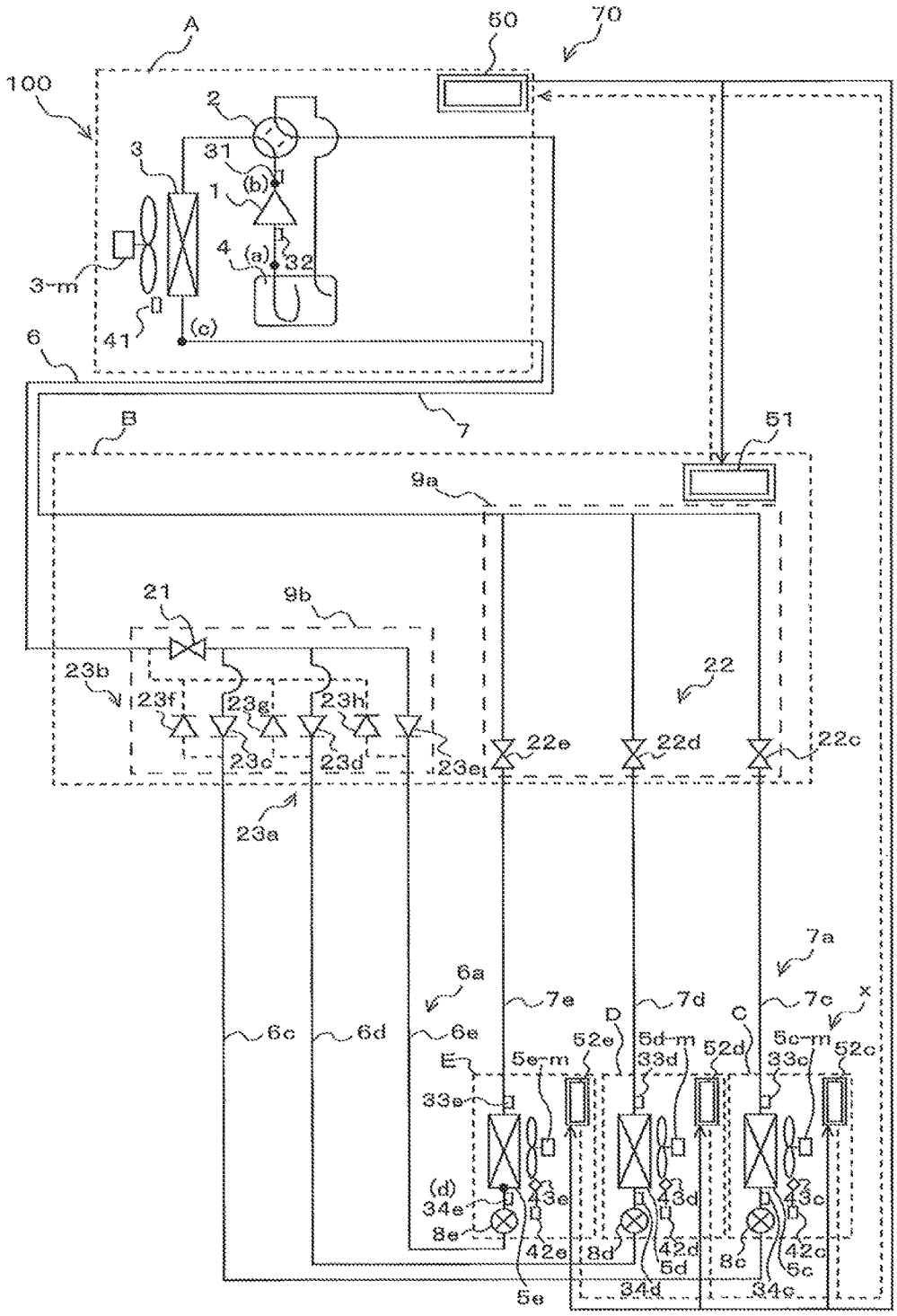
FIG. 2 is a circuit diagram for illustrating a cooling operation in Embodiment 1 of the present invention.
Figure 3:
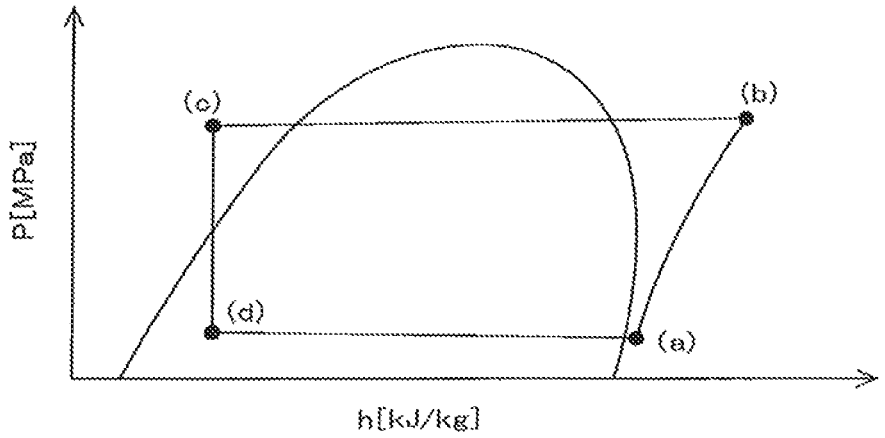
FIG. 3 is a P-h diagram of the cooling operation in Embodiment 1 of the present invention.

First, the cooling operation is described. In Embodiment 1, the first indoor unit C, the second indoor unit D, and the third indoor unit E all perform the cooling operation. When the cooling operation is performed, the flow switching unit 2 is switched so that the refrigerant discharged from the compressor 1 flows into the outdoor heat exchanger 3. FIG. 2 is a circuit diagram for illustrating the cooling operation in Embodiment 1 of the present invention, and FIG. 3 is a P-h diagram of the cooling operation in Embodiment 1 of the present invention.

As illustrated in FIG. 2, when drive is started, the compressor 1 sucks and compresses low-temperature and low-pressure gas refrigerant to discharge high-temperature and high-pressure gas refrigerant. During a compression process of the compressor 1 for compressing the refrigerant, the refrigerant is compressed so as to be heated rather than adiabatically compressed with an isentropic for the amount of adiabatic efficiency of the compressor 1 (line segment from a point (a) to a point (b) in FIG. 3).

The high-temperature and high-pressure gas refrigerant discharged from the compressor 1 flows into the outdoor heat exchanger 3 through the flow switching unit 2. At this time, the refrigerant is cooled while heating outdoor air sent from the outdoor air-sending device 3*m* to turn into intermediate-temperature and high-pressure liquid refrigerant. A state change of the refrigerant in the outdoor heat exchanger 3 is represented as the line segment from the point (b) to a point (c) in FIG. 3, which is slightly inclined from a horizontal line, in consideration of a pressure loss of the outdoor heat exchanger 3.

The intermediate-temperature and high-pressure liquid refrigerant flowing out of the outdoor heat exchanger 3 passes through the first connecting pipe 6, the first refrigerant shutoff valve 21 and the series check valves 23*a* in the first branch unit 9*b*, the first indoor unit-side connecting pipes 6*a*, and the indoor expansion units 8 in the stated order. Then, the intermediate-temperature and high-pressure liquid refrigerant is narrowed in the indoor expansion units 8 to be expanded and reduced in pressure into low-temperature and low-pressure two-phase gas-liquid refrigerant. The refrigerant in the indoor expansion units 8 changes its state in a state in which the enthalpy is constant. The state change of the refrigerant in the indoor expansion units 8 is represented as a vertical line from the point (c) to a point (d) in FIG. 3.

The low-temperature and low-pressure two-phase gas-liquid refrigerant flowing out of the indoor expansion units 8 flows into the indoor heat exchangers 5. At this time, the refrigerant is heated while cooling the indoor air sent from the indoor air-sending devices 5*a* to turn into low-temperature and low-pressure gas refrigerant. The state change of the refrigerant in the indoor heat exchangers 5 is represented as the line segment from the point (d) to the point (a) in FIG. 3, which is slightly inclined from a horizontal line, in consideration of a pressure loss of the indoor heat exchangers 5.

The low-temperature and low-pressure gas refrigerant flowing out of the indoor heat exchangers 5 passes through the second indoor unit-side connecting pipes 7*a* and the second refrigerant shutoff valves 22 to reach the second branch unit 9*a*. The low-temperature and low-pressure gas refrigerant joining together in the second branch unit 9*a* passes through the second connecting pipe 7 and the flow switching unit 2 to flow into the compressor 1 so as to be compressed.

(Heating Operation)

Figure 4:
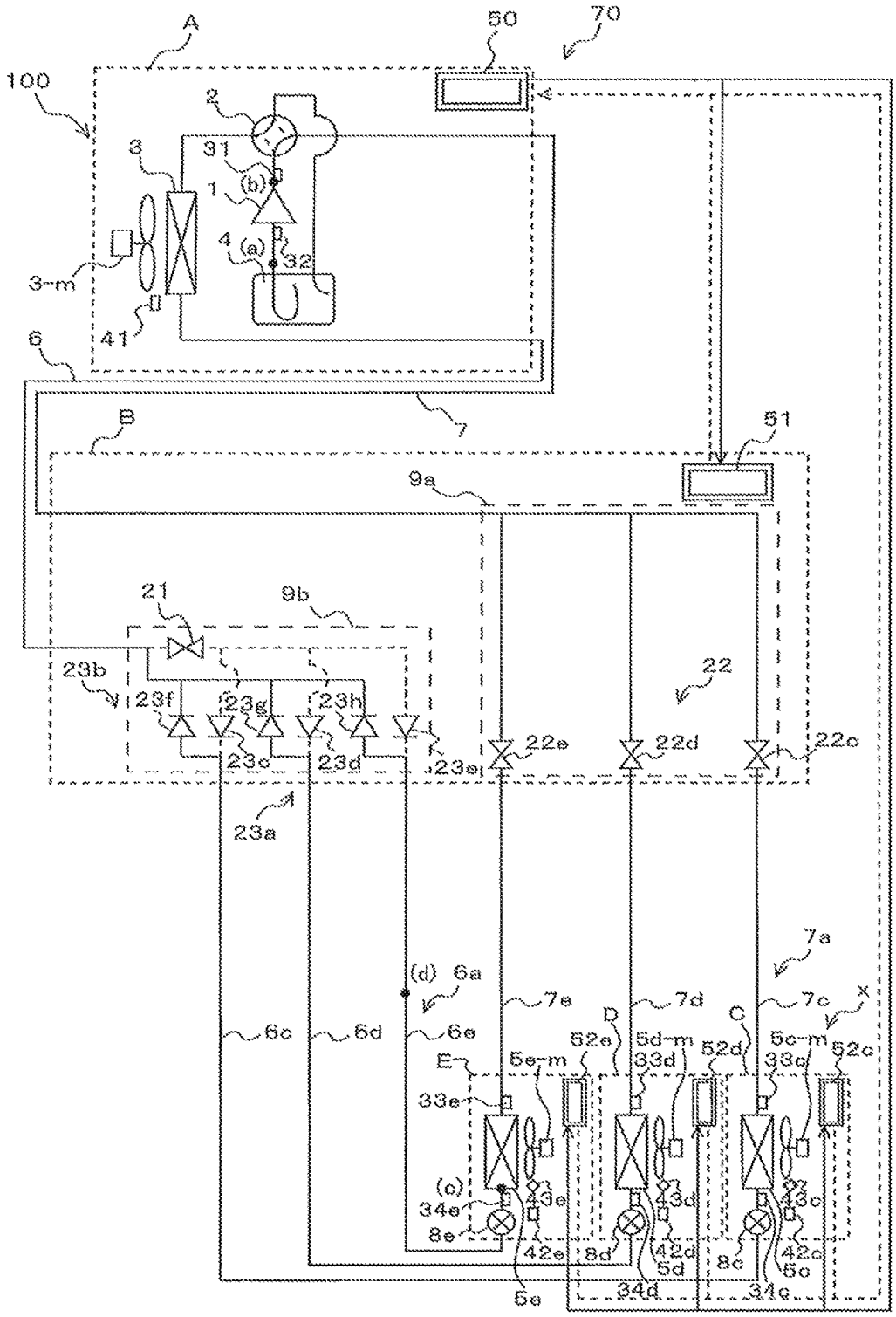
FIG. 4 is a circuit diagram for illustrating a heating operation in Embodiment 1 of the present invention.
Figure 5:
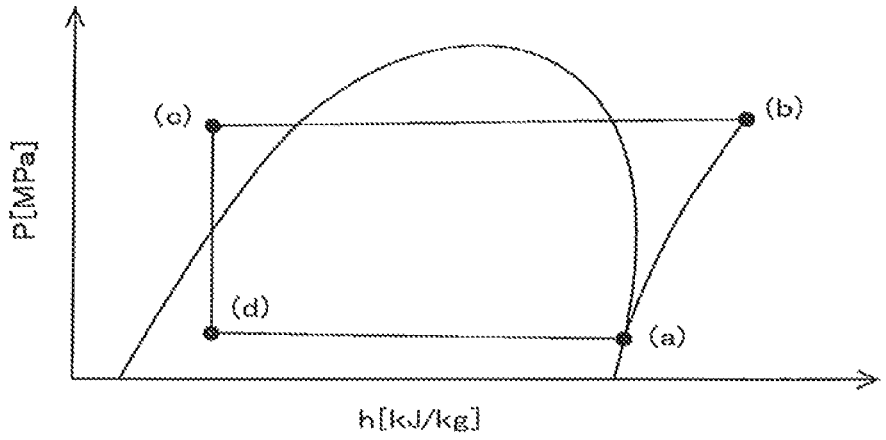
FIG. 5 is a P-h diagram of the heating operation in Embodiment 1 of the present invention.

Next, the heating operation is described. In Embodiment 1, the first indoor unit C, the second indoor unit D, and the third indoor unit E all perform the heating operation. When the heating operation is performed, the flow switching unit 2 is switched so that the refrigerant discharged from the compressor 1 flows into the second branch unit 9*a*. Further, in the heating operation, the refrigerant does not pass through the first refrigerant shutoff valve 21. Therefore, the first refrigerant shutoff valve 21 may be open or closed. FIG. 4 is a circuit diagram for illustrating the heating operation in Embodiment 1 of the present invention, and FIG. 5 is a P-h diagram of the heating operation in Embodiment 1 of the present invention.

As illustrated in FIG. 4, when drive is started, the compressor 1 sucks and compresses the low-temperature and low-pressure gas refrigerant to discharge high-temperature and high-pressure gas refrigerant. During a compression process of the compressor 1 for compressing the refrigerant, the refrigerant is compressed so as to be heated rather than adiabatically compressed with an isentropic for the amount of adiabatic efficiency of the compressor 1 (line segment from a point (a) to a point (b) in FIG. 5).

The high-temperature and high-pressure gas refrigerant discharged from the compressor 1 flows into the second branch unit 9*a* through the flow switching unit 2 and the second connecting pipe 7. At this time, the high-temperature and high-pressure gas refrigerant flowing into the second branch unit 9*a* is split in the second branch unit 9*a* to pass through the second refrigerant shutoff valves 22 and the second indoor unit-side connecting pipes 7*a* to flow into the indoor heat exchangers 5. At this time, the refrigerant itself is cooled while heating the indoor air sent from the indoor air-sending devices 5*a* to turn into intermediate-temperature and high-pressure liquid refrigerant. A state change of the refrigerant in the indoor heat exchangers 5 is represented as the line segment from a point (b) to a point (c) in FIG. 5, which is slightly inclined from a horizontal line, in consideration of a pressure loss of the indoor heat exchangers 5U.

The intermediate-temperature and high-pressure liquid refrigerant flowing out of the indoor heat exchangers 5 flows into the indoor expansion units 8 to be narrowed in the indoor expansion unit 8 to be expanded and reduced in pressure to turn into low-temperature and low-pressure two-phase gas-liquid refrigerant. The refrigerant in the indoor expansion units 8 changes its state in a state in which the enthalpy is constant. The state change of the refrigerant in the indoor expansion units 8 is represented as a vertical line from the point (c) to the point (d) in FIG. 5.

The low-temperature and low-pressure two-phase gas-liquid refrigerant flowing out of the indoor expansion units 8 passes through the first indoor unit-side connecting pipes 6*a*, the parallel check valves 23*b* in the first branch unit 9*b*, and the first connecting pipe 6 to flow into the outdoor heat exchanger 3. At this time, the refrigerant itself is heated while cooling the indoor air sent from the indoor air-sending device 3*m* to turn into low-temperature and low-pressure gas refrigerant. The state change of the refrigerant in the indoor heat exchangers 3 is represented as the line segment from the point (d) to the point (a) in FIG. 5, which is slightly inclined from a horizontal line, in consideration of a pressure loss of the indoor heat exchangers 3.

The low-temperature and low-pressure gas refrigerant flowing out of the outdoor heat exchanger 3 passes through the flow switching unit 2 to flow into the compressor 1 so as to be compressed therein.

(Refrigerant Recovery Operation)

Figure 6:
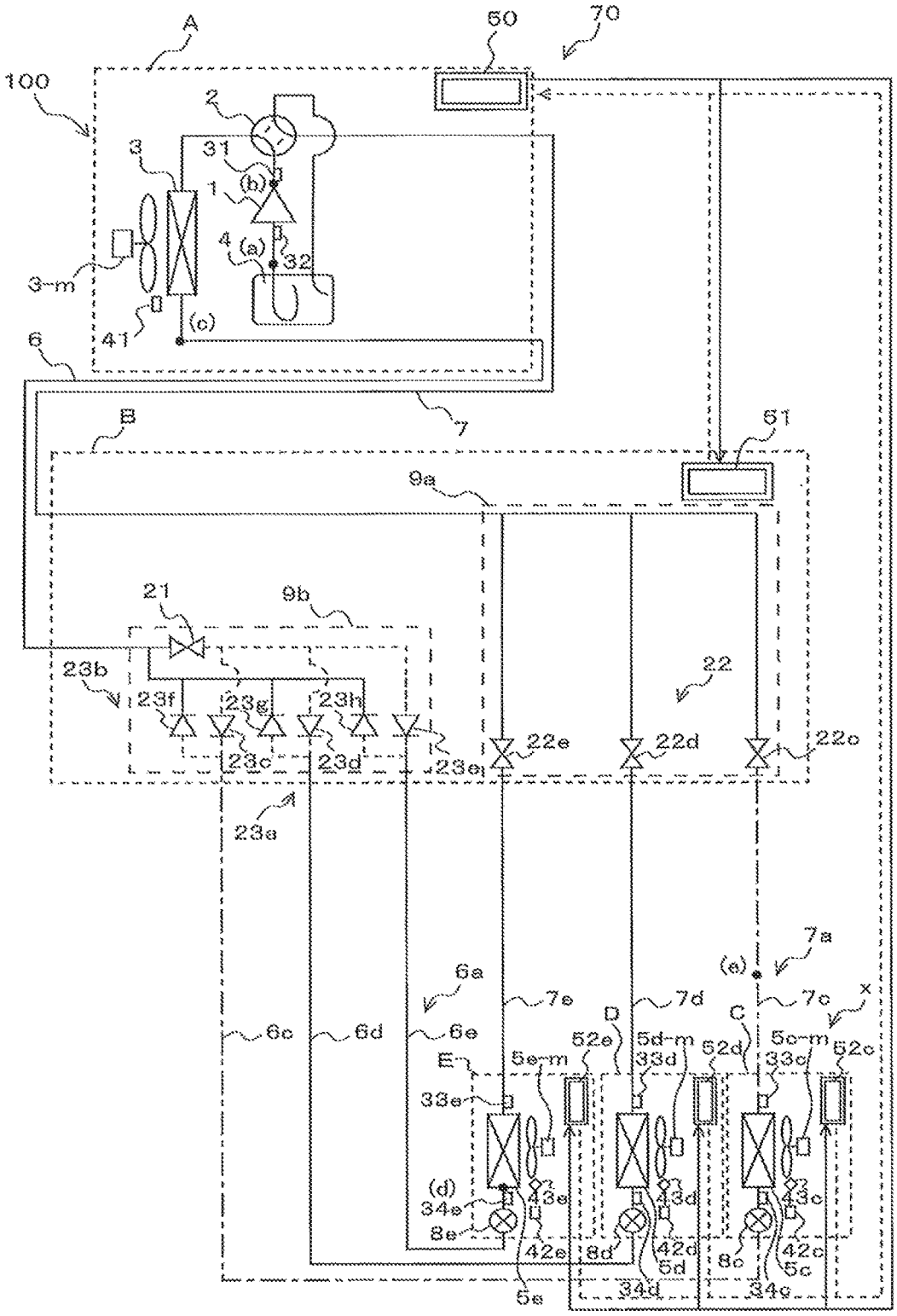
FIG. 6 is a circuit diagram for illustrating a refrigerant recovery operation in Embodiment 1 of the present invention.
Figure 7:
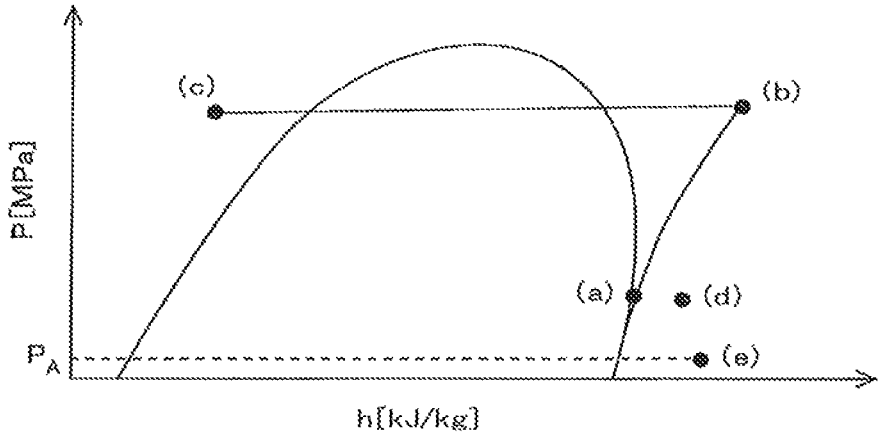
FIG. 7 is a P-h diagram of the refrigerant recovery operation in Embodiment 1 of the present invention.

Next, a refrigerant recovery operation for reducing the amount of refrigerant leaked indoors as much as possible when the refrigerant is leaked is described. When it is determined in the refrigerant leakage detecting units 43 that the refrigerant is leaked from the first indoor unit C, for example, the refrigerant leakage detecting unit 43 is a refrigerant concentration detecting unit configured to detect a refrigerant concentration and the refrigerant concentration in air exceeds a predetermined threshold value, the control unit 70 controls the flow switching unit 2 so that the outdoor heat exchanger 3 serves as a passage functioning as the condenser. When the operation mode at the time of detection of leakage of the refrigerant is the cooling operation, the passage remains unchanged. When the operation mode is the heating operation, the passage is directed in the opposite direction. Further, the control unit 70 closes the first refrigerant shutoff valve 21 and the twenty-first refrigerant shutoff valve 22*c*. FIG. 6 is a circuit diagram for illustrating the refrigerant recovery operation in Embodiment 1 of the present invention, and FIG. 7 is a P-h diagram of the refrigerant recovery operation in Embodiment 1 of the present invention.

As illustrated in FIG. 6, when the drive is started, the compressor 1 sucks and compresses the low-temperature and low-pressure gas refrigerant to discharge high-temperature and high-pressure gas refrigerant. In a compression process of the compressor 1 for compressing the refrigerant, the refrigerant is compressed so as to be heated rather than adiabatically compressed with an isentropic for the amount of adiabatic efficiency of the compressor 1 (line segment from a point (a) to a point (b) in FIG. 7).

The high-temperature and high-pressure gas refrigerant discharged from the compressor 1 flows into the outdoor heat exchanger 3 through the flow switching unit 2. At this time, the refrigerant itself is cooled while heating the outdoor air sent from the outdoor air-sending device 3*m* to turn into intermediate-temperature and high-pressure liquid refrigerant. A state change of the refrigerant in the outdoor heat exchanger 3 is represented as the line segment from the point (b) to a point (c) in FIG. 7, which is slightly inclined from a horizontal line, in consideration of a pressure loss of the outdoor heat exchanger 3.

After flowing through the first connecting pipe 6, the intermediate-temperature and high-pressure liquid refrigerant flowing out of the outdoor heat exchanger 3 is held back by the first refrigerant shutoff valve 21 in the first branch unit 9*b*. As a result, the liquid refrigerant is stored inside the first connecting pipe 6. In this manner, the outdoor heat exchanger 3 functions as the condenser. As a result, the refrigerant flowing out of the outdoor heat exchanger 3 turns into liquid refrigerant. The liquid refrigerant is more likely to stay inside the pipe than the gas refrigerant. Therefore, the refrigerant flowing through the refrigeration cycle is recovered as much as possible. Further, the twenty-first refrigerant shutoff valve 22*c* is closed. Therefore, the refrigerant flowing through the second indoor unit D, the third indoor unit E, and other units does not flow into the first indoor unit C to inhibit the leakage of the refrigerant. The twenty-second refrigerant shutoff valve 22*d* and the twenty-third refrigerant shutoff valve 22*e* are open, and therefore the pressure of the refrigerant in the second indoor heat exchanger 5*d* and the third indoor heat exchanger 5*e* is equal to a pressure on the suction side of the compressor 1 (point (d) in FIG. 7). Further, the refrigerant is leaked indoors, and a pressure of the refrigerant in the first indoor unit C is lowered to an atmospheric pressure PA eventually (point (e) in FIG. 7).

Further, when the refrigerant is leaked in any one of the first indoor unit C, the second indoor unit D, and the third indoor unit E, the relay control unit 51 of the relay unit B performs an opening and closing operation for the second refrigerant shutoff valve 22 connected to the indoor unit X into which the refrigerant is leaked and the first refrigerant shutoff valve 21. The second refrigerant shutoff valves 22 are open during the normal operation and are closed when the refrigerant is leaked. As a result, the refrigerant is prevented from flowing into the second indoor unit-side connecting pipes 7*a*. Further, the first refrigerant shutoff valve 21 is open during the normal operation and is closed when the refrigerant is leaked. As a result, when a pressure in the indoor unit X into which the refrigerant is leaked, the first indoor unit-side connecting pipes 6*a*, and the second indoor unit-side connecting pipes 7*a* is higher than the pressure in the first connecting pipe 6, the refrigerant, which passes through the parallel check valves 23*b* to be stored in the indoor unit X into which the refrigerant is leaked, the first indoor unit-side connecting pipes 6*a*, and the second indoor unit-side connecting pipes 7*a* is recovered into the first connecting pipe 6. Meanwhile, when the pressure in the indoor unit X into which the refrigerant is leaked, the first indoor unit-side connecting pipes 6*a*, and the second indoor unit-side connecting pipes 7*a* is lower than the pressure in the first connecting pipe 6, the refrigerant is prevented from flowing out into the indoor unit X into which the refrigerant is leaked, the first indoor unit-side connecting pipes 6*a*, and the second indoor unit-side connecting pipes 7*a*.

Here, the series check valves 23*a* (first series check valve 23*c*, second series check valve 23*d*, and third series check valve 23*e*) are configured to prevent the flow of the refrigerant between the indoor units X. When the refrigerant is leaked in any of the indoor units X and hence the first refrigerant shutoff valve 21 is shut off, the refrigerant on a side of the other indoor units X in which the refrigerant is not leaked can be prevented by the series check valves 23*a* from flowing toward the indoor unit X in which the refrigerant is leaked.

As described above, the air-conditioning apparatus 100 according to Embodiment 1 includes the number of first refrigerant shutoff valve 21, which is smaller than the number of indoor units X, in the first branch unit 9*b*. Therefore, cost reduction and simplification of control can be both achieved. Further, the first refrigerant shutoff valve 21 is provided to the first branch unit 9*b* in which the first indoor unit-side connecting pipes 6*a* of the indoor units X join together so as to be provided for each of the second indoor unit-side connecting pipes 7*a* of the indoor units X. Therefore, when the refrigerant is leaked indoors in any of the indoor units X, the refrigerant indoor leakage can be reduced as much as possible by closing the second refrigerant shutoff valve 22 provided to the second indoor unit-side connecting pipe 7*a* of the indoor unit X in which the leakage occurs and the first refrigerant shutoff valve 21 provided to the portion of the first branch unit 9*b* in which the first indoor unit-side connecting pipes 6*a* join together.

Further, when the refrigerant leakage detecting units 43 detect the leakage of the refrigerant in at least one of the plurality of indoor units X, the control unit 70 controls the flow switching unit 2 so that the outdoor heat exchanger 3 serves as the passage functioning as the condenser. Therefore, the refrigerant flowing out of the outdoor heat exchanger 3 turns into liquid refrigerant. The liquid refrigerant is more likely to stay inside the pipe than the gas refrigerant. Therefore, the amount of recovery of the refrigerant flowing through the refrigeration cycle can be increased.

Embodiment 2

Figure 8A:
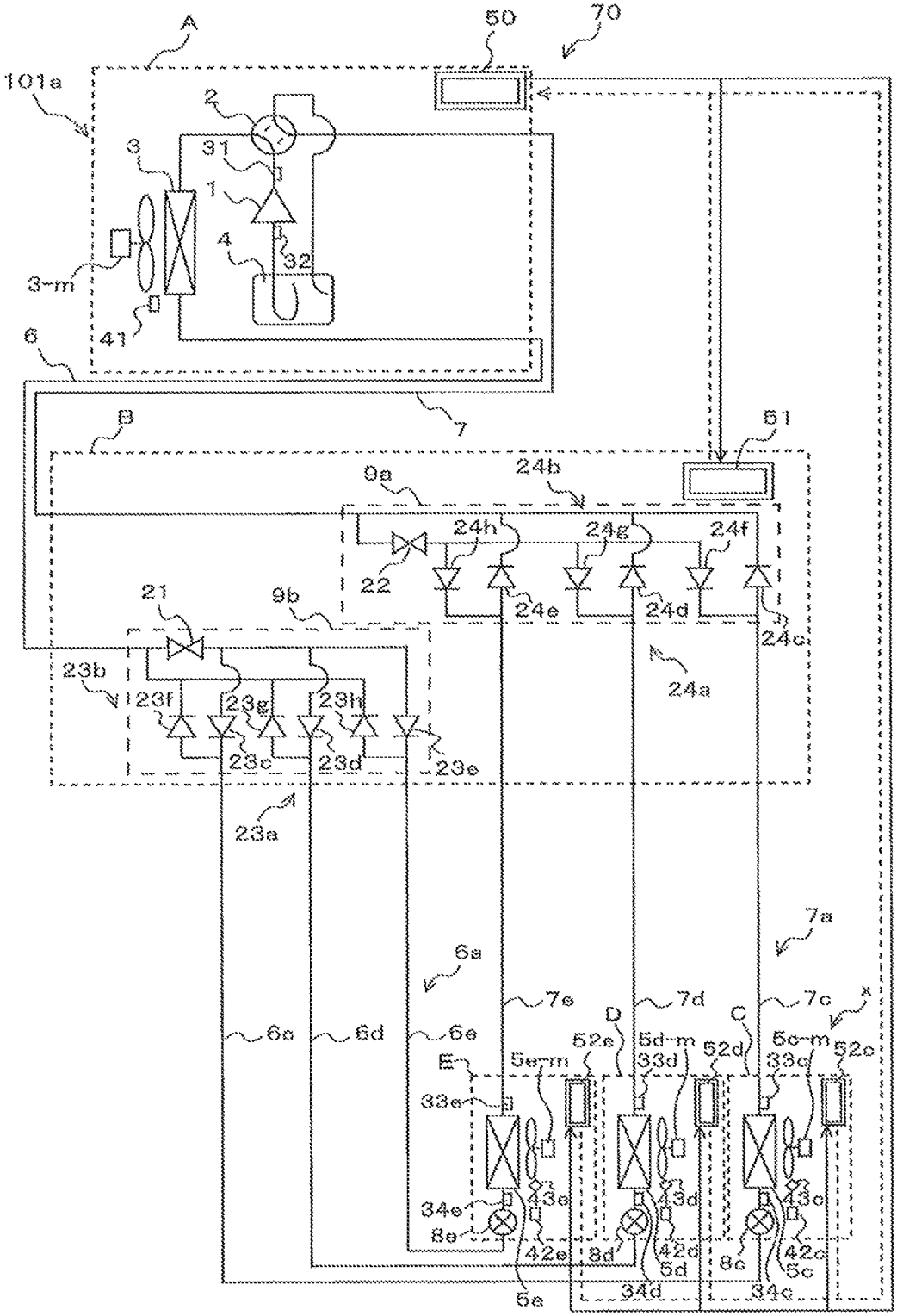
FIG. 8A is a circuit diagram for illustrating an air-conditioning apparatus 101*a* according to Embodiment 2 of the present invention.

Next, an air-conditioning apparatus 101*a* according to Embodiment 2 of the present invention is described. FIG. 8A is a circuit diagram for illustrating the air-conditioning apparatus 101*a* according to Embodiment 2 of the present invention. Embodiment 2 differs from Embodiment 1 in that the number of installed second refrigerant shutoff valves 22 in the relay unit B is smaller than the number of indoor units X. In Embodiment 2, the parts common to Embodiment 1 are denoted by the same reference symbols, and the description thereof is omitted, and differences from Embodiment 1 are mainly described.

As illustrated in FIG. 8A, the relay unit B includes indoor relay check valves 24*a* and relay indoor check valves 24*b*. The indoor relay check valves 24*a* are configured to allow the flow of the refrigerant from the indoor units X to the relay unit B in the second branch unit 9*a* in which the second indoor unit-side connecting pipes 7*a* connected to the plurality of indoor units X, specifically, the gas-side pipes in the cooling operation join together. The relay indoor check valves 24*b* are connected in parallel to the indoor relay check valves 24*a*, and are configured to allow the flow of the refrigerant from the relay unit B to the indoor units X in the second branch unit 9*a* in which the refrigerant is split into the gas-side pipes in the heating operation. The second refrigerant check valve 22 is provided on upstream of the pipe that branches to the relay indoor check valves 24*b*. Specifically, the second branch unit 9*a* includes the path configured to allow the flow of the refrigerant from the indoor units X to the relay unit B and the path configured to allow the flow of the refrigerant from the relay unit B to the indoor units X. The second refrigerant shutoff valve 22 is provided in the path configured to allow the flow of the refrigerant from the relay unit B to the indoor units X on upstream of branch points at which the path branches to the plurality of indoor units X.

Here, the "indoor relay check valves 24*a*" is a collective designation, and includes a first indoor relay check valve 24*c* provided to the twenty-first indoor unit-side connecting pipe 7*c*, a second indoor relay check valve 24*d* provided to the twenty-second indoor unit-side connecting pipe 7*d*, and a third indoor relay check valve 24*e* provided to the twenty-third indoor unit-side connecting pipe 7*e*. Meanwhile, the "relay indoor check valves 24*b*" is a collective designation, and includes a first relay indoor check valve 24*f* provided to the twenty-first indoor unit-side connecting pipe 7*c*, a second relay indoor check valve 24*g* provided to the twenty-second indoor unit-side connecting pipe 7*d*, and a third relay indoor check valve 24*h* provided to the twenty-third indoor unit-side connecting pipe 7*e*.

Here, the relay indoor check valves 24*b* (first relay indoor check valve 24*f*, second relay indoor check valves 24*g*, and third relay indoor check valve 24*h*) are configured to prevent the flow of the refrigerant between the indoor units X. When the refrigerant is leaked in any one of the indoor units X and the second relay shutoff valve 22 is shut off, the refrigerant on a side of the other indoor units X in which the refrigerant is not leaked can be prevented from flowing toward the indoor unit X into which the refrigerant is leaked.

The control unit 70 has a function of closing the first refrigerant shutoff valve 21 and the second refrigerant shutoff valve 22 when the refrigerant leakage detecting units 43 detect the leakage of the refrigerant in at least one of the plurality of indoor units X.

As described above, the air-conditioning apparatus 101*a* according to Embodiment 2 includes the number of second refrigerant shutoff valve 22, which is smaller than the number of indoor units X, in the second branch unit 9*a*. Therefore, the cost reduction and the simplification of control can be both achieved. Further, the first refrigerant shutoff valve 21 is provided to the first branch unit 9*b* in which the first indoor unit-side connecting pipes 6*a* connected to the indoor units X join together, whereas the second refrigerant shutoff valve 22 is provided to the second branch unit 9*a* in which the second indoor unit-side connecting pipes 7*a* connected to the indoor units X join together. Therefore, when the indoor refrigerant leakage occurs in any of the indoor units X, the indoor refrigerant leakage can be reduced as much as possible by closing the second refrigerant shutoff valve 22 provided to a portion of the second branch unit 9*a* where the second indoor unit-side connecting pipes 7*a* join together and the first refrigerant shutoff valve 21 provided to a portion of the first branch unit 9*b* where the first indoor unit-side connecting pipes 6*a* join together.

Further, when the refrigerant leakage detecting units 43 detect the leakage of the refrigerant in at least one of the plurality of indoor units X, the control unit 70 is configured to control the flow switching unit 2 so that the outdoor heat exchanger 3 serves as a passage functioning as the condenser. Thus, the refrigerant flowing out of the outdoor heat exchanger 3 turns into the liquid refrigerant. The liquid refrigerant is more likely to stay inside the pipe than the gas refrigerant. Therefore, the amount of recovery of the refrigerant flowing inside the refrigeration cycle can be increased.

(Variation of Embodiment 2)

Figure 8B:
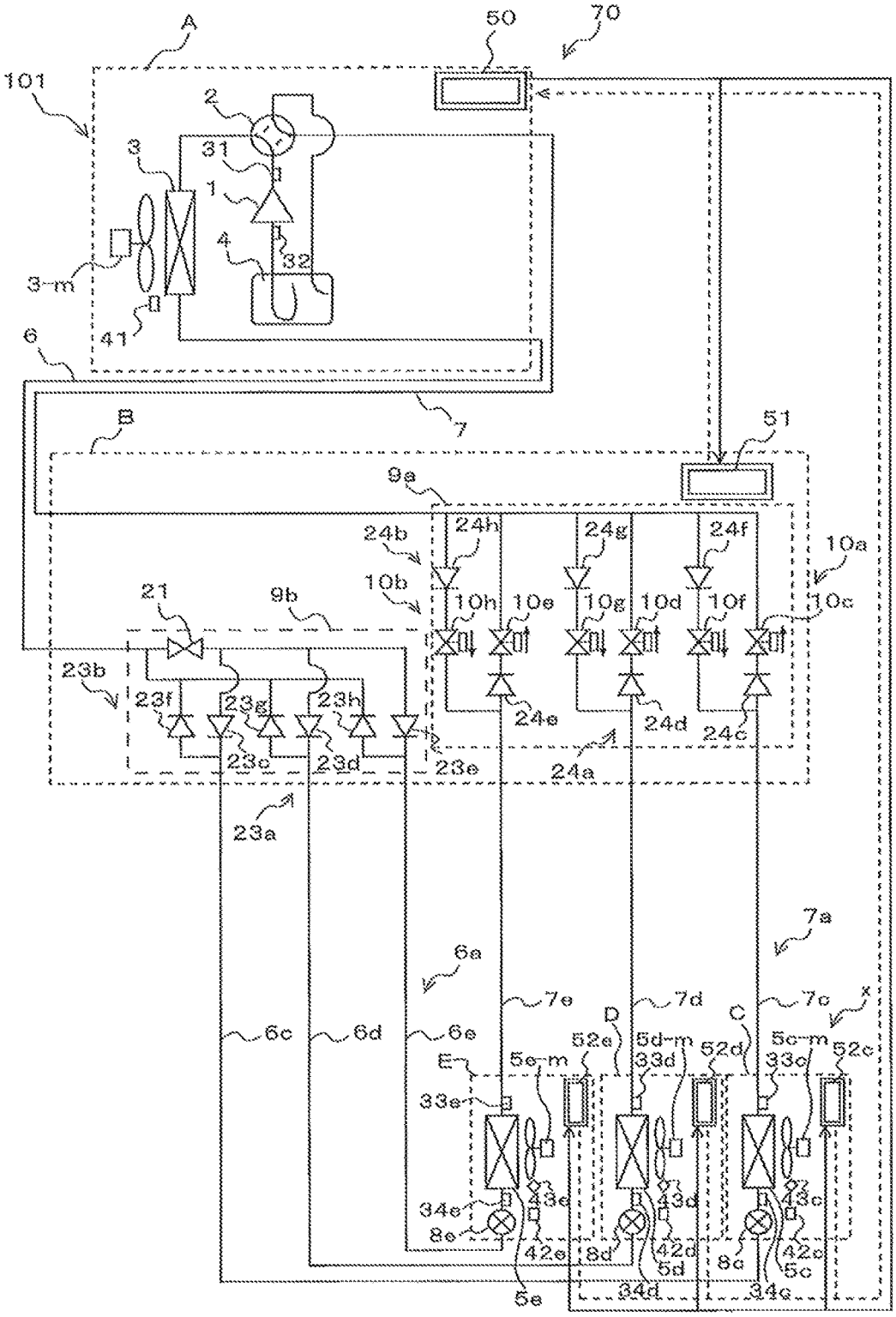
FIG. 8B is a circuit diagram for illustrating an air-conditioning apparatus 101 according to a variation of Embodiment 2 of the present invention.

Next, an air-conditioning apparatus 101 according to a variation of Embodiment 2 is described. FIG. 8B is a circuit diagram for illustrating the air-conditioning apparatus 101 according to the variation of Embodiment 2 of the present invention. The variation of Embodiment 2 differs from Embodiments 1 and 2 in that the relay unit B includes indoor relay flow control valves 10*a* and relay indoor flow control valves 10*b* without including the second refrigerant shutoff valve 22. In the variation of Embodiment 2, the parts common to Embodiments 1 and 2 are denoted by the same reference symbols, and the description thereof is omitted, and differences from Embodiments 1 and 2 are mainly described.

As illustrated in FIG. 8B, the relay unit B includes the indoor relay flow control valves 10*a*, the relay indoor flow control valves 10*b*, the indoor relay check valves 24*a*, and the relay indoor check valves 24*b*. The indoor relay flow control valves 10*a* are configured to control the flow of the refrigerant in one direction from the indoor units X toward the relay unit B in the second branch unit 9*a* in which the second indoor unit-side connecting pipes 7*a* connected to the plurality of indoor units X, that is, the gas-side pipes in the cooling operation join together. Further, the relay indoor flow control valves 10*b* are configured to control the flow of the refrigerant in one direction from the relay unit B toward the indoor units X, and are connected in parallel to the indoor relay flow control valves 10*a* in the second branch unit 9*a*. The indoor relay flow control valves 10*a* and the relay indoor flow control valves 10*b* are, for example, solenoid valves. Then, when the pressure of the refrigerant is higher on the side of the second branch unit 9*a* (distal end side of the arrows in FIG. 8B) than on the side of the indoor units X (base end side of the arrows in FIG. 8B), an opening and closing operation of each of the indoor relay flow control valves 10*a* is performed normally. Further, when the pressure of the refrigerant is higher on the side of the second branch unit 9*a* (base end side of the arrows in FIG. 8B) than on the side of the indoor units X (distal end side of the arrows in FIG. 8B), an opening and closing operation of each of the indoor relay flow control valves 10*b* is performed normally.

Figure 8C:
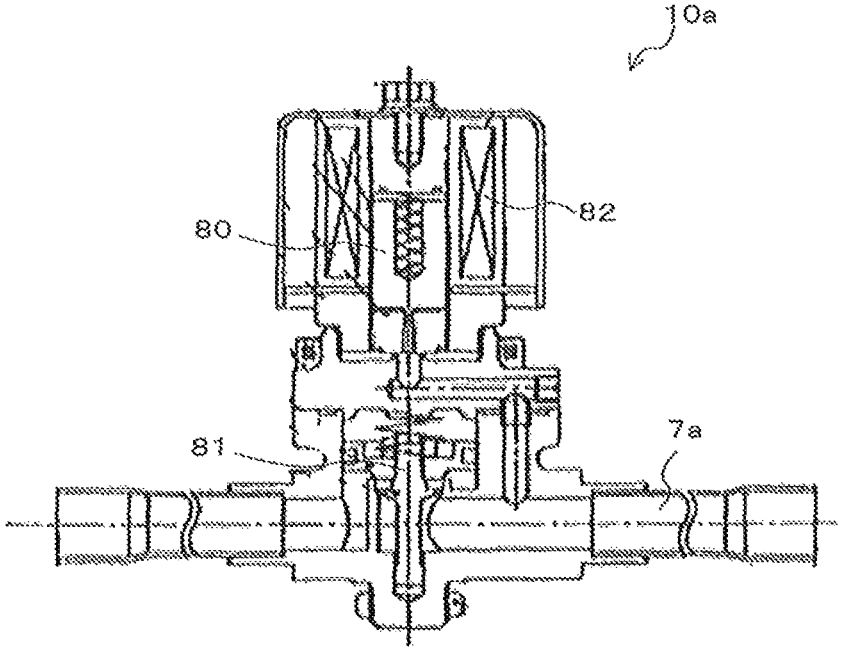
FIG. 8C is a view for illustrating a structure of an indoor relay flow control valve 10*a* in a variation of Embodiment 2 of the present invention.

FIG. 8C is a view for illustrating a structure of each of the indoor relay flow control valves 10*a* in the variation of Embodiment 2 of the present invention. Here, the structure of each of the indoor relay flow control valves 10*a* is described. As illustrated in FIG. 8C, each of the indoor relay flow control valves 10*a* is, for example, a pilot-type solenoid valve. The indoor relay flow control valve 10*a* (pilot-type solenoid valve) is a valve having a relatively large Cv value, in which a passage is closed by a plunger 80 and a main valve 81. The plunger 80 and the main valve 81 are independent of each other. In FIG. 8*c*, refrigerant in a low-pressure atmosphere is enclosed in the plunger 80. Then, the plunger 80 is actuated by an attracting force of a solenoid coil 82, and the main valve 81 is actuated by a fluid pressure. As a result, the main valve 81 having a large opening diameter can be operated with a simple structure and small capacity power. As described above, the valve configured to shut off the unidirectional flow is used in the variation of Embodiment 2. Therefore, cost can be reduced as compared to a case where the valve configured to shut off the bidirectional flow.

Each of the relay indoor flow control valves 10*b* may have the same structure as each of the indoor relay flow control valves 10*a*.

The "indoor relay flow control valves 10*a*" is a collective designation, and includes a first indoor relay flow control valve 10*c* provided to the twenty-first indoor unit-side connecting pipe 7*c*, a second indoor relay flow control valve 10*d* provided to the twenty-second indoor unit-side connecting pipe 7*d*, and a third indoor relay flow control valve 10*e* provided to the twenty-third indoor unit-side connecting pipe 7*e*. Further, the "relay indoor flow control valves 10*b*" is a collective designation, and includes a first relay indoor flow control valve 10*f* provided to the twenty-first indoor unit-side connecting pipe 7*c*, a second relay indoor flow control valve 10*g* provided to the twenty-second indoor unit-side connecting pipe 7*d*, and a third relay indoor flow control valve 10*h* provided to the twenty-third indoor unit-side connecting pipe 7*e*.

Further, the indoor relay check valves 24*a* are connected in series to the indoor relay flow control valves 10*a*, and are provided on upstream of the indoor relay flow control valves 10*a*. The indoor relay check valves 24*a* may be provided on downstream of the indoor relay flow control valves 10*a*. Further, the relay indoor check valves 24*b* are connected in parallel to the relay indoor flow control valves 10*b*, and are provided on upstream of the relay indoor flow control valves 10*b*. The relay indoor check valves 24*b* may be provided on downstream of the relay indoor flow control valves 10*b*. As described above, the indoor relay check valves 24*a* are connected in series to the indoor relay flow control valves 10*a*, and the relay indoor check valves 24*b* are connected in series to the relay indoor flow control valve 10*b*. As a result, even when the direction of flow of the refrigerant in the refrigeration cycle varies, the opening and closing operation of each of the indoor relay flow control valves 10*a* and the relay indoor flow control valves 10*b* is performed normally. The indoor relay flow control valves 10*a* can be omitted, and therefore only the indoor relay check valves 24*a* may be installed.

The "indoor relay check valves 24*a*" is a collective designation, and includes the first indoor relay check valve 24*c* provided to the twenty-first indoor unit-side connecting pipe 7*c*, the second indoor relay check valve 24*d* provided to the twenty-second indoor unit-side connecting pipe 7*d*, and the third indoor relay check valve 24*e* provided to the twenty-third indoor unit-side connecting pipe 7*e*. The "relay indoor check valves 24*b*" is a collective designation, and includes the first relay indoor check valve 24*f* provided to the twenty-first indoor unit-side connecting pipe 7*c*, the second relay indoor check valve 24*g* provided to the twenty-second indoor unit-side connecting pipe 7*d*, and the third relay indoor check valve 24*h* provided to the twenty-third indoor unit-side connecting pipe 7*e*.

The control unit 70 has a function of opening the indoor relay flow control valve 10*a* connected to the indoor unit X into which the refrigerant is leaked, closing the relay indoor flow control valve 10*b* connected to the indoor unit X into which the refrigerant is leaked, and closing the first refrigerant shutoff valve 21 when the refrigerant leakage detecting unit 43 detects the leakage of the refrigerant in at least one of the plurality of indoor units X.

When the cooling operation is performed by the indoor units X, the indoor relay flow control valves 10*a* are open and the relay indoor flow control valves 10*b* are closed. Further, when the heating operation is performed by the indoor units X, the relay indoor flow control valves 10*b* are open and the indoor relay flow control valves 10*a* are closed.

When the refrigerant leakage detecting units 43 detect the leakage of the refrigerant in at least one of the plurality of indoor units X, the control unit 70 is configured to control the flow switching unit 2 so that the outdoor heat exchanger 3 serves as a passage functioning as the condenser. Then, the control unit 70 opens the indoor relay flow control valve 10*a* connected to the indoor unit X into which the refrigerant is leaked, closes the relay indoor flow control valve 10*b* connected to the indoor unit X into which the refrigerant is leaked, and closes the first refrigerant shutoff valve 21.

Next, functions of the air-conditioning apparatus 101 according to the variation of Embodiment 2 are described. The relay indoor flow control valve 10*b* connected to the indoor unit X into which the refrigerant is leaked is closed. Hence, the refrigerant does not flow through the indoor unit X in which the pressure is lowered so as to be close to the atmospheric pressure due to the leakage of the refrigerant. Further, in the variation of Embodiment 2, when the leakage of the refrigerant is detected by the refrigerant leakage detecting units 43, the control unit 70 controls the flow switching unit 2 so that the outdoor heat exchanger 3 serves as a passage functioning as the condenser. Along therewith, a speed of the compressor 1 is increased to lower a suction pressure of the compressor 1 (point (a) in FIG. 7) in the control unit 70. As described above, the air-conditioning apparatus 101 decreases the suction pressure of the compressor 1 so as to be lower than the pressure of the indoor unit X in which the leakage of the refrigerant occurs. As a result, the refrigerant can be easily recovered from all the indoor units X including the indoor unit X in which the leakage of the refrigerant occurs, through the indoor relay check valves 24*a*. Therefore, the amount of leakage of the refrigerant leaked indoors can be reduced as much as possible.

Embodiment 3

Figure 9:
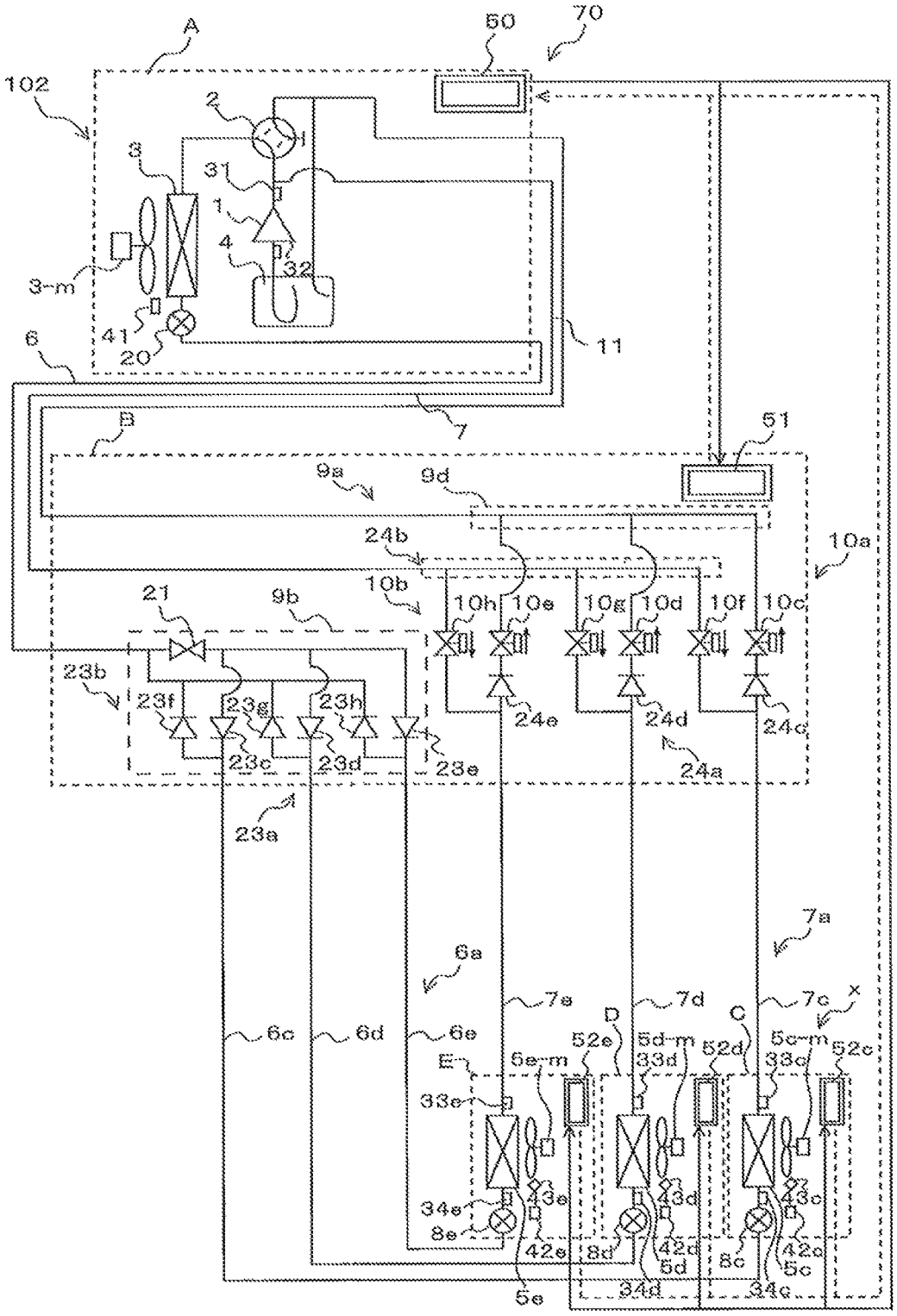
FIG. 9 is a circuit diagram for illustrating an air-conditioning apparatus 102 according to Embodiment 3 of the present invention.

Next, an air-conditioning apparatus 102 according to Embodiment 3 of the present invention is described. FIG. 9 is a circuit diagram for illustrating the air-conditioning apparatus 102 according to Embodiment 3 of the present invention. Embodiment 3 differs from Embodiment 2 in that the second branch unit 9*a* includes a third branch unit 9*c* connected to the discharge side of the compressor 1 and a fourth branch unit 9*d* connected to the suction side of the compressor 1. In Embodiment 3, the parts common to Embodiments 1 and 2 are denoted by the same reference symbols, and the description thereof is omitted, and differences from Embodiments 1 and 2 are mainly described.

As illustrated in FIG. 9, one end of a third connecting pipe 11 is connected to the discharge side of the compressor 1, whereas the third branch unit 9*c* included in the second branch unit 9*a* is connected to an other end of the third connecting pipe 11. The refrigerant is split from the third branch unit 9*c* into the relay indoor flow control valves 10*b*. The third branch unit 9*c* is connected to the discharge side of the compressor 1 through the third connecting pipe 11, and hence the direction of flow of the refrigerant is constant. Therefore, the relay indoor check valves 24*b* of Embodiment 2 are omitted.

Then, the fourth branch unit 9*d* included in the second branch unit 9*a* is connected to the second connecting pipe 7. In the fourth branch unit 9*d*, the refrigerant from the indoor relay flow control valves 10*a* joins together. Further, the outdoor unit A includes an outdoor expansion unit 20 which is provided to the first connecting pipe 6 on the side close to the outdoor heat exchanger 3.

Due to opening and closing of the indoor relay flow control valves 10*a* and the relay indoor flow control valves 10*b* included in the relay unit B, the indoor units X are switched to be connected to the discharge side of the compressor 1 or the suction side of the compressor 1. As a result, the indoor units X perform the cooling operation or the heating operation. Then, when the compressor 1 operates in a state without the leakage of the refrigerant, pressures in the respective branch units have a relationship: pressure in the third branch unit 9*c*>pressure in the first branch unit 9*b*>pressure in the fourth branch unit 9*d*. Therefore, the indoor relay flow control valves 10*a* and the relay indoor flow control valves 10*b* operate normally. As in Embodiment 2, the indoor relay check valves 24*a* are connected in series to the indoor relay flow control valves 10*a*. Therefore, even when the leakage of the refrigerant occurs in the indoor unit X and the pressure on the side close to the indoor units X is lowered, the refrigerant flowing through other than the indoor unit X in which the leakage of the refrigerant occurs does not flow into the indoor unit X in which the leakage of the refrigerant occurs.

Next, an operation of the air-conditioning apparatus 102 according to Embodiment 3 is described. The air-conditioning apparatus 102 according to Embodiment 3 is capable of performing a cooling and heating simultaneous operation in which cooling or heating is selected for each of the indoor units X so that the indoor units X for which the cooling is performed and the indoor units X for which the heating operation is performed exist at the same time. Then, as the operation mode of the air-conditioning apparatus 102 according to Embodiment 3, four modes corresponding to the cooling operation, the heating operation, a cooling main operation, and a heating main operation are provided. Specifically, in addition to the cooling operation and the heating operation of the air-conditioning apparatus 100 according to Embodiment 1 and the air-conditioning apparatus 101 according to Embodiment 2, the two operation modes are further provided. In the cooling main operation, a cooling load is larger than a heating load in the cooling and heating simultaneous operation, and the outdoor heat exchanger 3 is connected to the discharge side of the compressor 1 to function as the condenser. Further, in the heating main operation, the heating load is larger than the cooling load in the cooling and heating simultaneous operation, and the outdoor heat exchanger 3 is connected to the suction side of the compressor 1 to function as the evaporator.

In the cooling operation, the refrigerant flows in a state in which the indoor relay flow control valves 10*a* are open and the relay indoor flow control valves 10*b* are closed. Further, in the heating operation, the refrigerant flows in a state in which the indoor relay flow control valves 10*a* are closed and the relay indoor flow control valves 10*b* are open. The cooling operation and the heating operation are the same as those in Embodiments 1 and 2, and therefore the description thereof is omitted. Hereinafter, operations in the cooling main operation and the heating main operation are described with reference to a P-h diagram.

(Cooling Main Operation)

Figure 10:
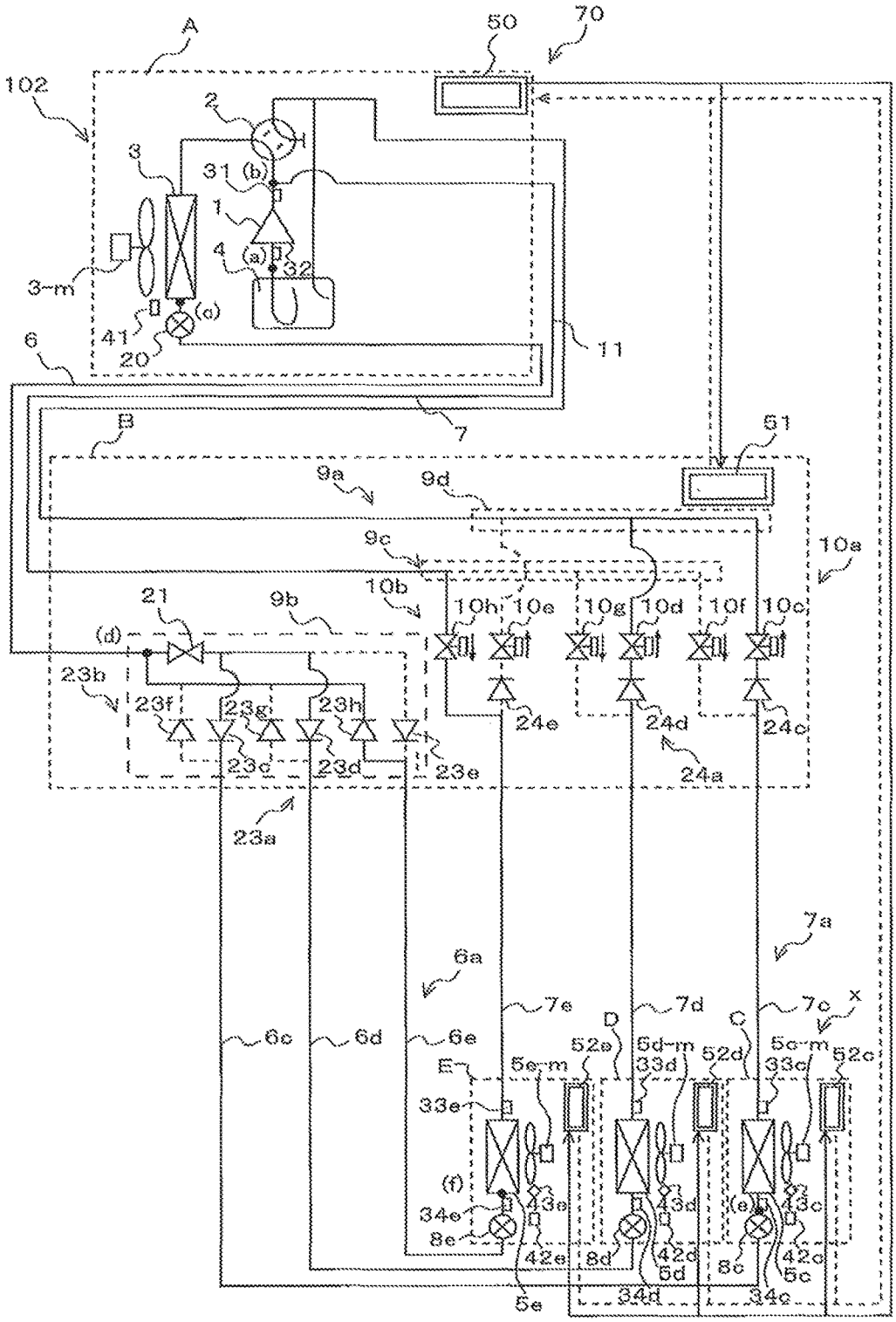
FIG. 10 is a circuit diagram for illustrating a cooling main operation in Embodiment 3 of the present invention.
Figure 11:
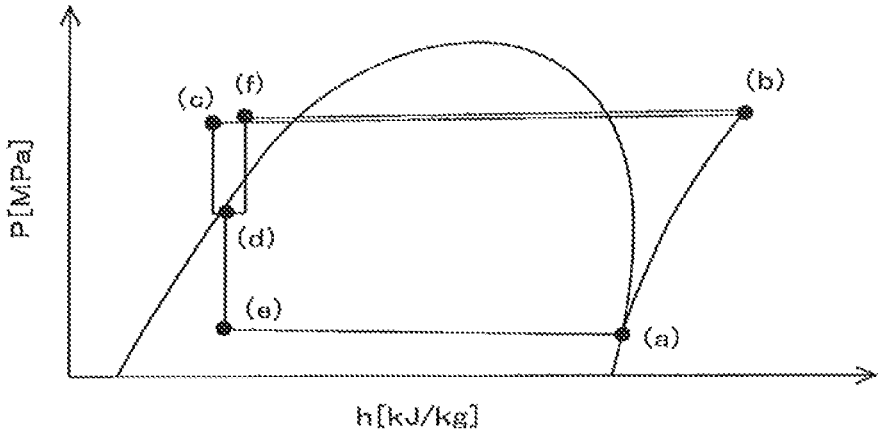
FIG. 11 is a P-h diagram of the cooling main operation in Embodiment 3 of the present invention.

First, the cooling main operation is described. In Embodiment 3, the first indoor unit C and the second indoor unit D perform the cooling operation, whereas the third indoor unit E performs the heating operation. Specifically, the first indoor relay flow control valve 10*c* and the second indoor relay flow control valve 10*d* are open, whereas the third indoor relay flow control valve 10*e* is closed. Further, the first relay indoor flow control valve 10*f* and the second relay indoor flow control valve 10*g* are closed, whereas the third relay indoor flow control valve 10*h* is open. In the case of the cooling main operation, the flow switching unit 2 is switched so that the refrigerant discharged from the compressor 1 flows into the outdoor heat exchanger 3. FIG. 10 is a circuit diagram for illustrating the cooling main operation in Embodiment 3 of the present invention, and FIG. 11 is a P-h diagram of the cooling main operation in Embodiment 3 of the present invention.

As illustrated in FIG. 10, when the drive is started, the compressor 1 sucks and compresses low-temperature and low-pressure gas refrigerant to discharge high-temperature and high-pressure gas refrigerant. During a compression process of the compressor 1 for compressing the refrigerant, the refrigerant is compressed so as to be heated rather than adiabatically compressed with an isentropic for the amount of adiabatic efficiency of the compressor 1 (line segment from a point (a) to a point (b) in FIG. 11).

The high-temperature and high-pressure gas refrigerant discharged from the compressor 1 is split into refrigerant flowing toward the flow switching unit 2 and refrigerant flowing toward the third connecting pipe 11. Among them, the refrigerant flowing toward the flow switching unit 2 flows into the outdoor heat exchanger 3 through the flow switching unit 2. At this time, the refrigerant itself is cooled while heating the outdoor air sent from the outdoor air-sending device 3*m* to turn into intermediate-temperature and high-pressure liquid refrigerant. A state change of the refrigerant in the outdoor heat exchanger 3 is represented as the line segment from the point (b) to a point (c) in FIG. 11, which is slightly inclined from a horizontal line, in consideration of a pressure loss of the outdoor heat exchanger 3.

The intermediate-temperature and high-pressure liquid refrigerant flowing out of the outdoor heat exchanger 3 is narrowed in the outdoor expansion unit 20 to be expanded and reduced in pressure to turn into low-temperature and low-pressure two-phase gas-liquid refrigerant. The refrigerant changes its state in the outdoor expansion unit 20 in a state in which the enthalpy is constant. The state change of the refrigerant in the outdoor heat expansion unit 20 is represented as a vertical line from the point (c) to a point (d) in FIG. 11. Thereafter, the refrigerant flows into the first branch unit 9*b* through the first connecting pipe 6.

Meanwhile, the refrigerant flowing from the compressor 1 to the third connecting pipe 11 then flows into the third branch unit 9*c* and passes through the third relay indoor flow control valve 10*h* to flow into the second indoor unit-side connecting pipes 7*a*. Then, the refrigerant flows into the third indoor heat exchanger 5*e*. At this time, the refrigerant itself is cooled while heating the indoor air sent from the third indoor air-sending device 5*em* to turn into intermediate-temperature and high-pressure liquid refrigerant. A state change of the refrigerant in the indoor heat exchangers 5 is represented as the line segment from the point (b) to a point (f) in FIG. 11, which is slightly inclined from a horizontal line, in consideration of a pressure loss of the indoor heat exchangers 5.

The intermediate-temperature and high-pressure liquid refrigerant flowing out of the third indoor heat exchanger 5*e* flows into the third indoor expansion unit 8*e* to be narrowed in the third indoor expansion unit 8*e* to be expanded and reduced in pressure to turn into low-temperature and low-pressure two-phase gas-liquid refrigerant. The refrigerant in the indoor expansion unit 8 changes its state in a state in which the enthalpy is constant. The state change of the refrigerant in the indoor expansion unit 8 is represented as a vertical line from the point (f) to a point (d) in FIG. 11. The enthalpy is not sometimes the same at the point (c) and the point (f) in FIG. 11 depending on a degree of subcooling of the refrigerant. Thereafter, the refrigerant passes through the thirteenth indoor unit-side connecting pipe 6*e* to flow into the first branch unit 9*b*. At this time, the refrigerant joins the refrigerant that flows out of the outdoor expansion unit 20 to flow through the first connecting pipe 6.

After passing through the first refrigerant shutoff valve 21, the refrigerant joining in the first branch unit 9*b* is split into the first series check valve 23*c* and the second series check valve 23*d* to flow therethrough. The refrigerant that has passed through the first series check valve 23*c* and the refrigerant that has passed through the second series check valve 23*d* respectively pass through the eleventh indoor unit-side connecting pipe 6*c* and the twelfth indoor unit-side connecting pipe 6*d* to respectively flow into the first indoor expansion unit 8*c* and the second indoor expansion unit 8*d*. Then, intermediate-temperature and high-pressure liquid refrigerant is narrowed in the first indoor expansion unit 8*c* and the second indoor expansion unit 8*d* to be expanded and reduced in pressure to turn into low-temperature and low-pressure two-phase gas-liquid refrigerant. The refrigerant in the first indoor expansion unit 8*c* and the second indoor expansion unit 8*d* change their states in a state in which the enthalpy is constant. The state change of the refrigerant in the first indoor expansion unit 8*c* and the second indoor expansion unit 8*d* is represented as a vertical line from the point (d) to a point (e) in FIG. 11.

The low-temperature and low-pressure two-phase gas-liquid refrigerant flowing out of the first indoor expansion unit 8*c* and that flowing out of the second indoor expansion unit 8*d* respectively flow into the first indoor heat exchanger 5*c* and the second indoor heat exchanger 5*d*. At this time, the refrigerant itself is heated while cooling the indoor air sent from the first indoor air-sending device 5*cm* and the second indoor air-sending device 5*dm* to turn into low-temperature and low-pressure gas refrigerant. A state change of the refrigerant in the first indoor heat exchanger 5*c* and in the second indoor heat exchanger 5*d* is represented as the line segment from the point (e) to a point (a) in FIG. 11, which is slightly inclined from a horizontal line, in consideration of a pressure loss of the first indoor heat exchanger 5*c* and the second indoor heat exchanger 5*d*.

The low-temperature and low-pressure gas refrigerant flowing out of the first indoor heat exchanger 5*c* and that flowing out of the second indoor heat exchanger 5*d* respectively pass through the twenty-first indoor unit-side connecting pipe 7*c* and the twenty-second indoor unit-side connecting pipe 7*d*, the first indoor relay check valve 24*c* and the second indoor relay check valve 24*d*, and the first indoor relay flow control valve 10*c* and the second indoor relay flow control valve 10*d* to join together in the fourth branch unit 9*d*. The low-temperature and low-pressure gas refrigerant joining together in the fourth branch unit 9*d* passes through the second connecting pipe 7 and the flow switching unit 2 to flow into the compressor 1 so as to be compressed therein.

(Heating Main Operation)

Figure 12:
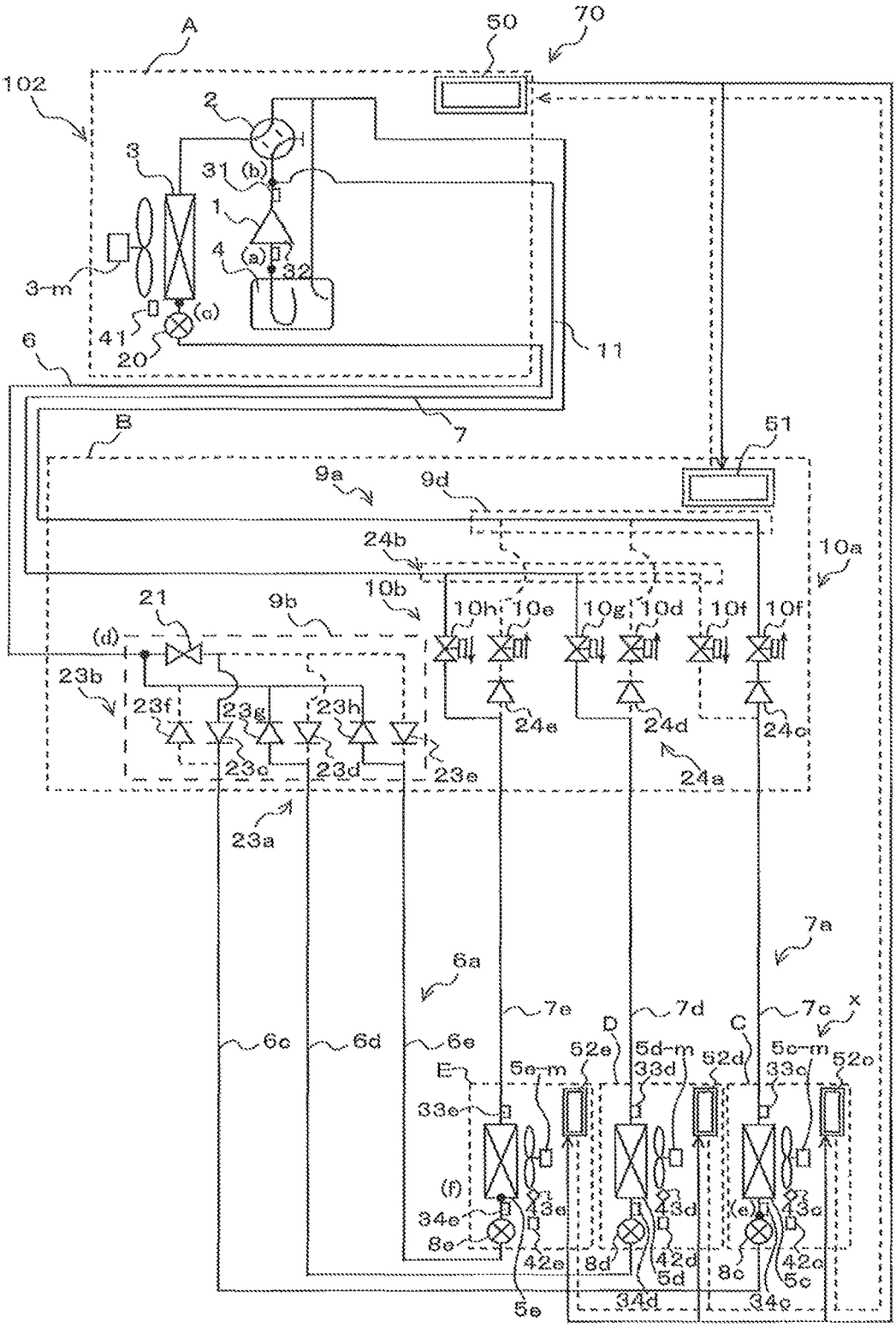
FIG. 12 is a circuit diagram for illustrating a heating main operation in Embodiment 3 of the present invention.
Figure 13:
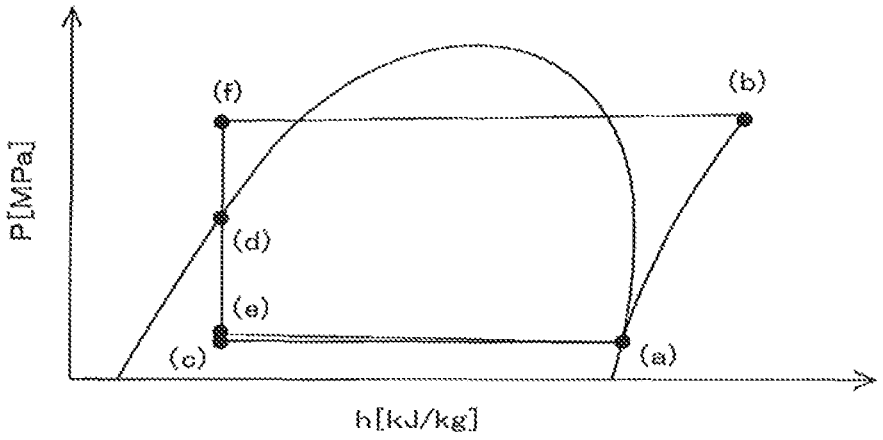
FIG. 13 is a P-h diagram of the heating main operation in Embodiment 3 of the present invention.

Next, the heating main operation is described. In Embodiment 3, the first indoor unit C performs the cooling operation, whereas the second indoor unit D and the third indoor unit E perform the heating operation. FIG. 12 is a circuit diagram for illustrating the heating main operation in Embodiment 3 of the present invention. FIG. 13 is a P-h diagram of the heating main operation in Embodiment 3 of the present invention. As illustrated in FIG. 12, the first indoor relay flow control valve 10*c* is open, whereas the second indoor relay flow control valve 10*d* and the third indoor relay flow control valve 10*e* are closed. Further, the first relay indoor flow control valve 10*f* is closed, whereas the second relay indoor flow control valve 10*g* and the third relay indoor flow control valve 10*h* are open.

In the case of the heating main operation, the flow switching unit 2 is switched so that the refrigerant discharged from the compressor 1 flows into the outdoor heat exchanger 3. The heating main operation differs from the cooling main operation in that the outdoor heat exchanger 3 is connected in parallel to the indoor heat exchanger 5 performing the cooling in the heating main operation, and that the outdoor heat exchanger 3 is connected in parallel to the indoor heat exchanger 5 performing the heating in the cooling main operation. Specifically, in the heating main operation, the refrigerant in the first connecting pipe 6 flows from the relay unit B to the outdoor unit A reversely to the cooling main operation, and the refrigerant changes from the point (d) through the point (c) to the point (a) in the stated order as shown in FIG. 13.

(Refrigerant Recovery Operation)

Figure 14:
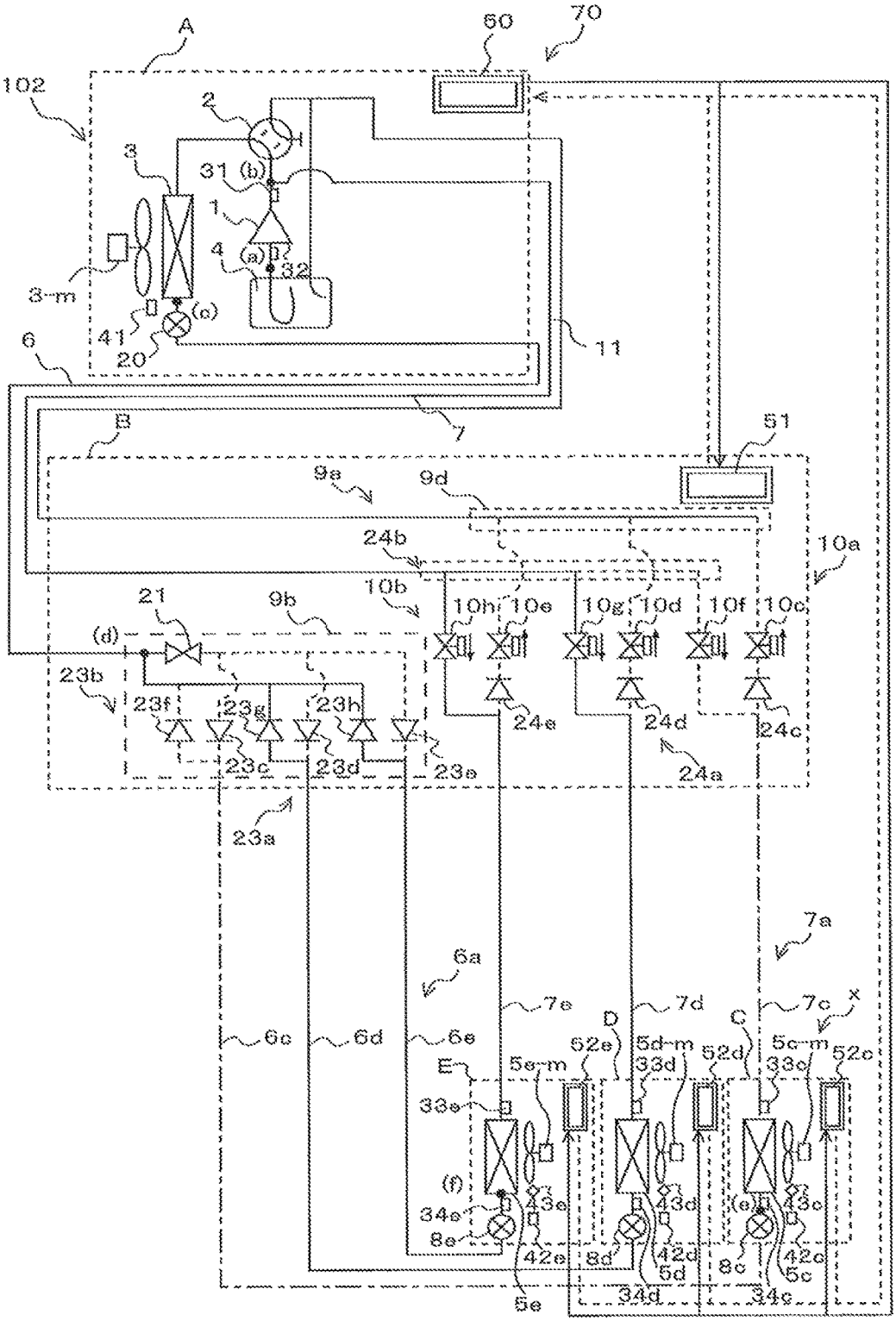
FIG. 14 is a circuit diagram for illustrating a refrigerant recovery operation in Embodiment 3 of the present invention.
Figure 15:
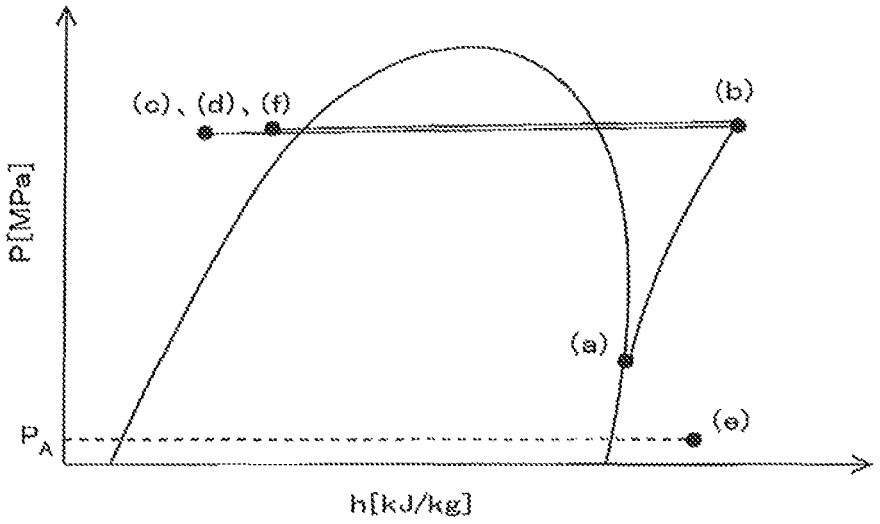
FIG. 15 is a P-h diagram of the refrigerant recovery operation in Embodiment 3 of the present invention.

Next, a refrigerant recovery operation for reducing the amount of refrigerant leaked indoors as much as possible when the refrigerant is leaked is described. FIG. 14 is a circuit diagram for illustrating the refrigerant recovery operation in Embodiment 3 of the present invention, and FIG. 15 is a P-h diagram of the refrigerant recovery operation in Embodiment 3 of the present invention. When it is determined in the refrigerant leakage detecting units 43 that the refrigerant is leaked from the first indoor unit C, for example, the refrigerant leakage detecting unit 43 is a refrigerant concentration detecting unit configured to detect a refrigerant concentration and the refrigerant concentration in air exceeds a predetermined threshold value, the control unit 70 controls the flow switching unit 2 so that the outdoor heat exchanger 3 serves as the passage functioning as the condenser. When the operation mode at the time of detection of leakage of the refrigerant is the cooling operation or the cooling main operation, the passage remains unchanged. When the operation mode is the heating operation or the heating main operation, the passage is directed in the opposite direction.

Further, the control unit 70 opens the first indoor relay flow control valve 10*c*, closes the first relay indoor flow control valve 10*f*, and closes the first refrigerant shutoff valve 21. For the second indoor relay flow control valve 10*d*, the third indoor relay flow control valve 10*e*, the second relay indoor flow control valve 10*g*, and the third relay indoor flow control valve 10*h*, the open and closed states in any of the cooling operation and the heating operation may be set. For storing the refrigerant inside the refrigeration cycle, the open and closed state similar to those in the heating operation are set as illustrated in FIG. 14 and FIG. 15. As a result, the pressures in the indoor units X are increased to increase a refrigerant density. Therefore, an increased amount of refrigerant can be stored.

As illustrated in FIG. 14, when the drive is started, the compressor 1 sucks and compresses the low-temperature and low-pressure gas refrigerant to discharge high-temperature and high-pressure gas refrigerant. In a compression process of the compressor 1 for compressing the refrigerant, the refrigerant is compressed so as to be heated rather than adiabatically compressed with an isentropic for the amount of adiabatic efficiency of the compressor 1 (line segment from a point (a) to a point (b) in FIG. 15).

The high-temperature and high-pressure gas refrigerant discharged from the compressor 1 flows into the outdoor heat exchanger 3 through the flow switching unit 2. At this time, the refrigerant itself is cooled while heating the outdoor air sent from the outdoor air-sending device 3*m* to turn into intermediate-temperature and high-pressure liquid refrigerant. A state change of the refrigerant in the outdoor heat exchanger 3 is represented as the line segment from the point (b) to a point (c) in FIG. 15, which is slightly inclined from a horizontal line, in consideration of a pressure loss of the outdoor heat exchanger 3.

After flowing through the first connecting pipe 6, the intermediate-temperature and high-pressure liquid refrigerant flowing out of the outdoor heat exchanger 3 is held back by the first refrigerant shutoff valve 21 in the first branch unit 9*b*. As a result, the liquid refrigerant is stored inside the first connecting pipe 6. In this manner, the outdoor heat exchanger 3 functions as the condenser. As a result, the refrigerant flowing out of the outdoor heat exchanger 3 turns into liquid refrigerant. The liquid refrigerant is more likely to stay inside the pipe than the gas refrigerant. Therefore, the refrigerant flowing through the refrigeration cycle is recovered as much as possible.

Further, the first relay indoor flow control valve 10*f* is closed. Therefore, the refrigerant flowing through the second indoor unit D, the third indoor unit E, and other units does not flow into the first indoor unit C to inhibit the leakage of the refrigerant. The second relay indoor flow control valve 10*g* and the third relay indoor flow control valve 10*h* are open, and therefore the pressure of the refrigerant in the second indoor heat exchanger 5*d* and the third indoor heat exchanger 5*e* is equal to a pressure on the discharge side of the compressor 1 (point (d) in FIG. 15). Further, the refrigerant is leaked indoors, and a pressure of the refrigerant in the first indoor unit C is lowered to the atmospheric pressure PA eventually (point (e) in FIG. 15).

As described above, the air-conditioning apparatus 102 according to Embodiment 3 includes the number of first refrigerant shutoff valve 21, which is smaller than the number of indoor units X, in the first branch unit 9*b*. Therefore, cost reduction and simplification of control can be both achieved. Further, the first refrigerant shutoff valve 21 is provided to the first branch unit 9*b* in which the first indoor unit-side connecting pipes 6*a* of the indoor units X join together, and the indoor relay flow control valves 10*a* and the relay indoor flow control valves 10*b* are provided for each of the second indoor unit-side connecting pipes 7*a* of the indoor units X. Therefore, when the refrigerant is leaked indoors in any of the indoor units X, the refrigerant indoor leakage can be reduced as much as possible by closing the relay indoor flow control valves 10*b* provided to the second indoor unit-side connecting pipe 7*a* of the indoor unit X in which the leakage occurs and the first refrigerant shutoff valve 21 provided to the portion of the first branch unit 9*b* in which the first indoor unit-side connecting pipes 6*a* join together.

Further, when the refrigerant leakage detecting units 43 detect the leakage of the refrigerant in at least one of the plurality of indoor units X, the control unit 70 controls the flow switching unit 2 so that the outdoor heat exchanger 3 serves as the passage functioning as the condenser. Therefore, the refrigerant flowing out of the outdoor heat exchanger 3 turns into liquid refrigerant. The liquid refrigerant is more likely to stay inside the pipe than the gas refrigerant. Therefore, the amount of recovery of the refrigerant flowing through the refrigeration cycle can be increased.

Embodiment 4

Figure 16:
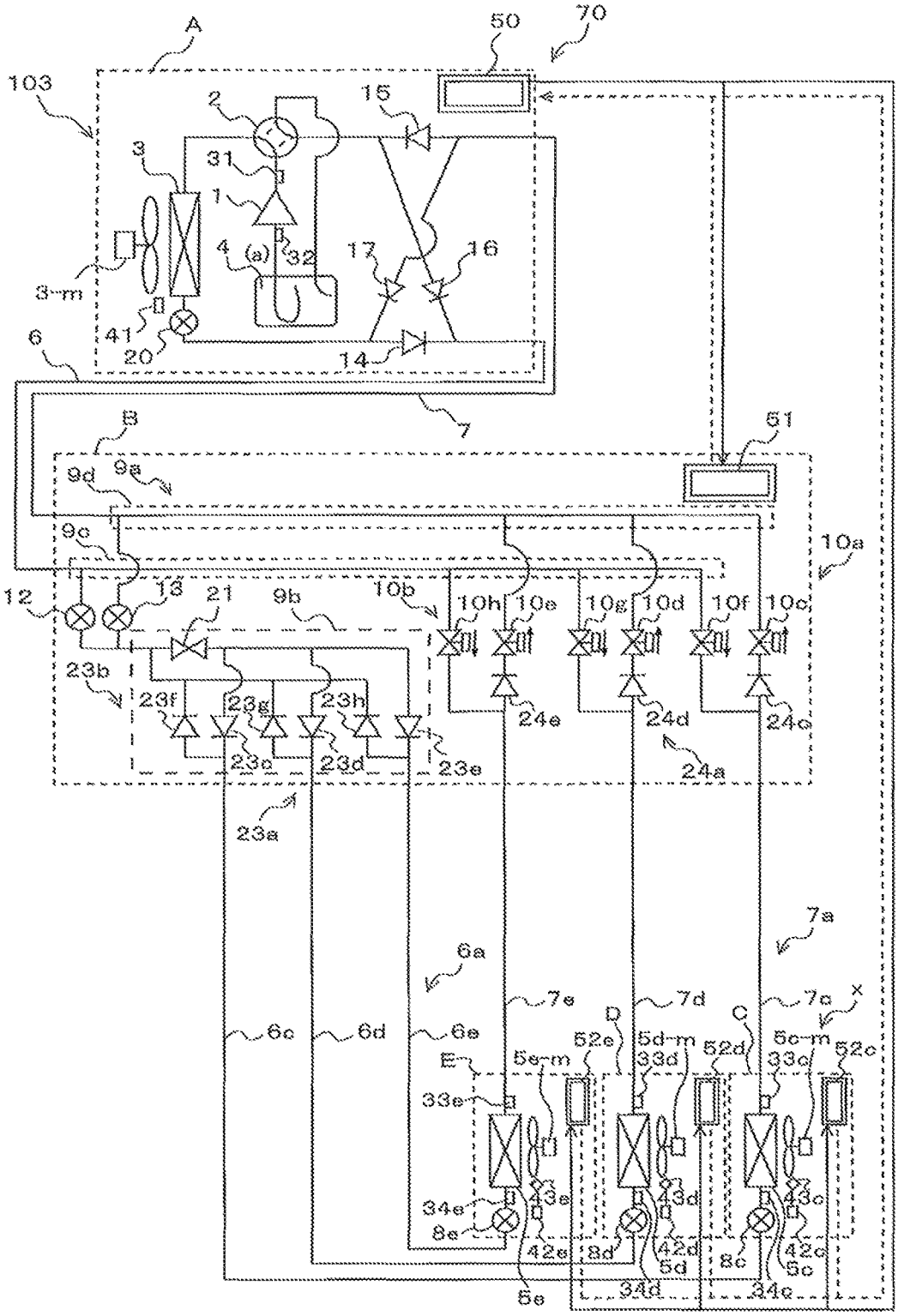
FIG. 16 is a circuit diagram for illustrating an air-conditioning apparatus 103 according to Embodiment 4 of the present invention.

Next, an air-conditioning apparatus 103 according to Embodiment 4 of the present invention is described. FIG. 16 is a circuit diagram for illustrating the air-conditioning apparatus 103 according to Embodiment 4 of the present invention. Embodiment 4 differs from Embodiment 2 in that the first connecting pipe 6 serves as a high-pressure pipe through which the refrigerant constantly flows from the outdoor unit A to the relay unit B, and that the second connecting pipe 7 serves as a low-pressure pipe through which the refrigerant constantly flows from the relay unit B to the outdoor unit A. In Embodiment 4, the parts common to Embodiments 1, 2, and 3 are denoted by the same reference symbols, and the description thereof is omitted, and differences from Embodiments 1, 2, and 3 are mainly described.

As illustrated in FIG. 16, a first check valve 14 configured to allow the flow of the refrigerant from the outdoor unit A to the relay unit B is provided to the first connecting pipe 6, whereas a second check valve 15 configured to allow the flow of the refrigerant from the relay unit B to the outdoor unit A is provided to the second connecting pipe 7. Further, a third check valve 16 configured to allow the flow of the refrigerant from the second connecting pipe 7 to the first connecting pipe 6 is provided to a pipe connecting the first connecting pipe 6 located on downstream of the first check valve 14 and the second connecting pipe 7 located on downstream of the second check valve 15. Still further, a fourth check valve 17 configured to allow the flow of the refrigerant from the second connecting pipe 7 to the first connecting pipe 6 is provided to a pipe connecting the first connecting pipe 6 located on upstream of the first check valve 14 and the second connecting pipe 7 located on upstream of the second check valve 15. As a result, the first connecting pipe 6 serves as a high-pressure pipe through which the refrigerant constantly flows from the outdoor unit A to the relay unit B, whereas the second connecting pipe 7 serves as a low-pressure pipe through which the refrigerant constantly flows from the relay unit B to the outdoor unit A.

In Embodiment 4, the first branch unit 9*b* is connected to both the first connecting pipe 6 and the second connecting pipe 7. A first expansion unit 12 is provided between the first branch unit 9*b* and the first connecting pipe 6. Further, a second expansion unit 13 is provided between the first branch unit 9*b* and the second connecting pipe 7. Further, the third branch unit 9*c* is connected to the first connecting pipe 6. The third branch unit 9*c* is placed under a high pressure close to the discharge pressure and the second branch unit 9*a* is placed under a low pressure close to the suction pressure by the first check valve 14, the second check valve 15, the third check valve 16, and the fourth check valve 17 regardless of the operation mode. Further, the first expansion unit 12 and the second branch unit 13 control the pressure of the refrigerant which has turned into an intermediate-pressure liquid in the first branch unit 9*b*, a low-pressure gas or two-phase gas-liquid in the second branch unit 9*a*, and a high-pressure gas or two-phase gas-liquid in the third branch unit 9*c*.

(Refrigerant Recovery Operation)

In the cooling and heating simultaneous operation, the outdoor heat exchanger 3 is connected to upstream of the indoor heat exchanger 5 performing the heating during the cooling main operation, whereas the outdoor heat exchanger 3 is connected to downstream of the indoor heat exchanger 5 performing the cooling during the heating main operation. There is described a refrigerant recovery operation when the refrigerant is leaked in the air-conditioning apparatus 103 according to Embodiment 4 in which the first connecting pipe 6 and the second connecting pipe 7 are connected by two pipes so as to be capable of performing the cooling and heating simultaneous operation.

Figure 17:
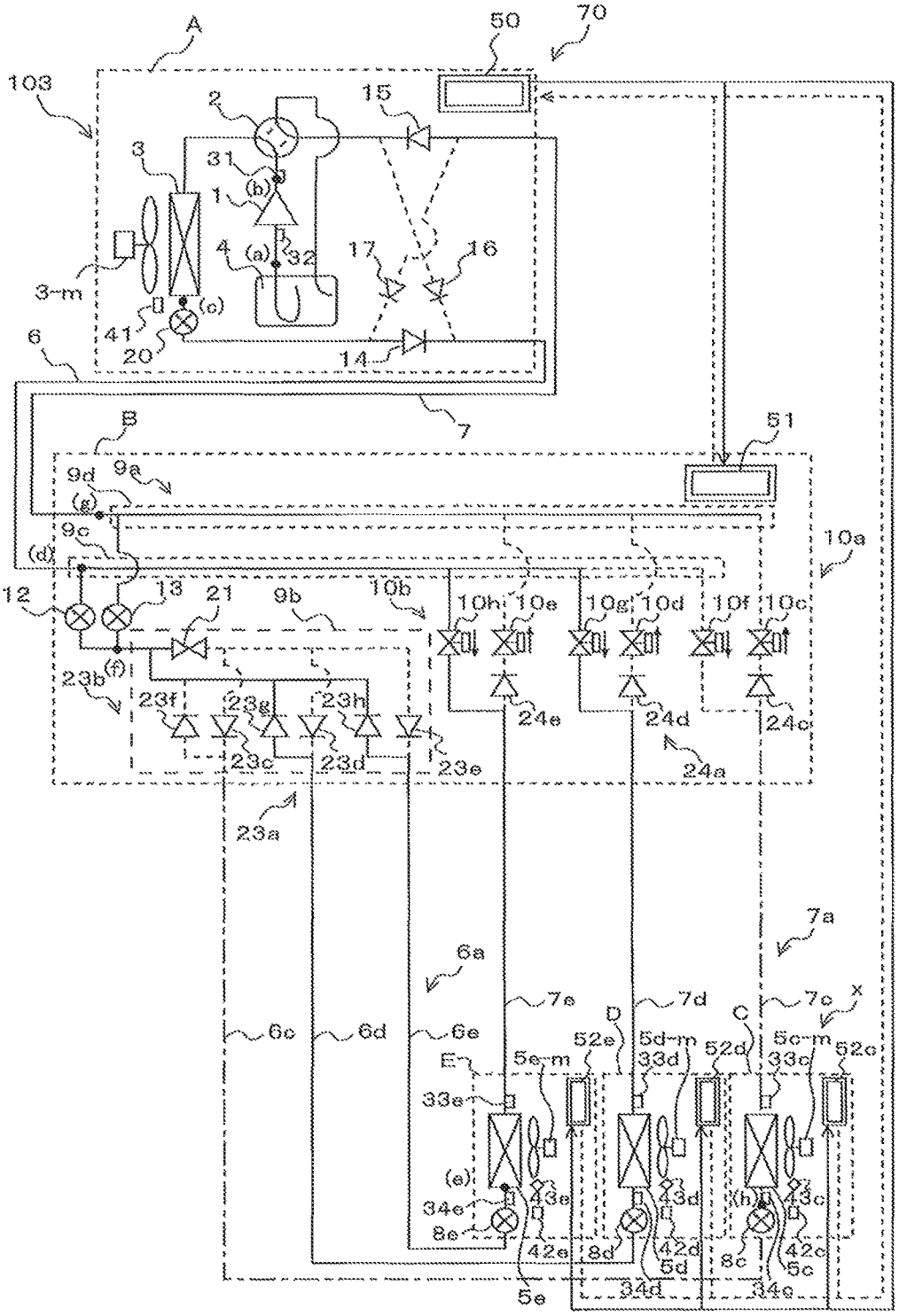
FIG. 17 is a circuit diagram for illustrating a refrigerant recovery operation in Embodiment 4 of the present invention.
Figure 18:
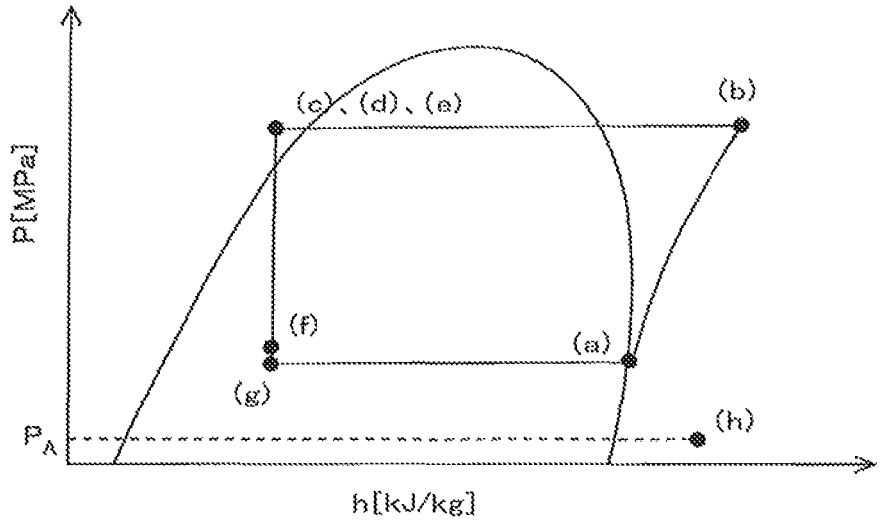
FIG. 18 is a P-h diagram of the refrigerant recovery operation in Embodiment 4 of the present invention.

FIG. 17 is a circuit diagram for illustrating the refrigerant recovery operation in Embodiment 4 of the present invention, and FIG. 18 is a P-h diagram of the refrigerant recovery operation in Embodiment 4 of the present invention. When it is determined in the refrigerant leakage detecting units 43 that the refrigerant is leaked from the third indoor unit E, for example, the refrigerant leakage detecting unit 43 is the refrigerant concentration detecting unit configured to detect a refrigerant concentration and the refrigerant concentration in air exceeds a predetermined threshold value, the control unit 70 controls the flow switching unit 2 so that the outdoor heat exchanger 3 serves as the passage functioning as the condenser. When the operation mode at the time of detection of leakage of the refrigerant is the cooling operation or the cooling main operation, the passage remains unchanged. When the operation mode is the heating operation or the heating main operation, the passage is directed in the opposite direction.

Further, the control unit 70 opens the first indoor relay flow control valve 10*c*, closes the first relay indoor flow control valve 10*f*, and closes the first refrigerant shutoff valve 21. Still further, the control unit 70 opens the second expansion unit 13 and closes the first expansion unit 12, the second indoor expansion unit 8*d*, and the third indoor expansion unit 8*e*. For the second indoor relay flow control valve 10*d*, the third indoor relay flow control valve 10*e*, the second relay indoor flow control valve 10*g*, and the third relay indoor flow control valve 10*h*, open and closed states in any of the cooling operation and the heating operation may be set. For storing the refrigerant inside the refrigeration cycle, the open and closed states similar to those during the heating operation are set as illustrated in FIG. 17 and FIG. 18. As a result, the pressures in the indoor units X are increased to increase the refrigerant density. Therefore, an increased amount of refrigerant can be stored.

As illustrated in FIG. 17, when the drive is started, the compressor 1 sucks and compresses the low-temperature and low-pressure gas refrigerant to discharge high-temperature and high-pressure gas refrigerant. In a compression process of the compressor 1 for compressing the refrigerant, the refrigerant is compressed so as to be heated rather than adiabatically compressed with an isentropic for the amount of adiabatic efficiency of the compressor 1 (line segment from a point (a) to a point (b) in FIG. 18).

The high-temperature and high-pressure gas refrigerant discharged from the compressor 1 flows into the outdoor heat exchanger 3 through the flow switching unit 2. At this time, the refrigerant itself is cooled while heating the outdoor air sent from the outdoor air-sending device 3*m* to turn into intermediate-temperature and high-pressure liquid refrigerant. A state change of the refrigerant in the outdoor heat exchanger 3 is represented as the line segment from the point (b) to a point (c) in FIG. 18, which is slightly inclined from a horizontal line, in consideration of a pressure loss of the outdoor heat exchanger 3.

After flowing through the first connecting pipe 6, the intermediate-temperature and high-pressure liquid refrigerant flowing out of the outdoor heat exchanger 3 is held back by the first refrigerant shutoff valve 21 in the first branch unit 9*b*. As a result, the liquid refrigerant is stored inside the first connecting pipe 6. In this manner the outdoor heat exchanger 3 functions as the condenser. As a result, the refrigerant flowing out of the outdoor heat exchanger 3 turns into liquid refrigerant. The liquid refrigerant is more likely to stay inside the pipe than the gas refrigerant. Therefore, the refrigerant flowing through the refrigeration cycle is recovered as much as possible.

Further, the second relay indoor flow control valve 10*g* and the third relay indoor flow control valve 10*h* are open. Therefore, the second indoor heat exchanger 5*d* in the second indoor unit D and the second indoor heat exchanger 5*d* in the third indoor unit E are positioned downstream of the first connecting pipe 6. Therefore, the liquid refrigerant is stored (point (d) and point (e) in FIG. 18, respectively). Further, the first expansion unit 12, the second indoor expansion unit 8*d*, and the third indoor expansion unit 8*e* are closed. Therefore, the refrigerant stored in the twelfth indoor unit-side connecting pipe 6*d* and the thirteenth indoor unit-side connecting pipe 6*e*, and the second indoor heat exchanger 5*d* and the third indoor heat exchanger 5*e* does not return to the first connecting pipe 6, the second connecting pipe 7, and other pipes. The second expansion unit 13 is open. Therefore, the intermediate pressure is lowered to be approximately equal to the suction pressure of the compressor 1 (point (f) of FIG. 18). Further, the pressure in the fourth branch unit 9*d* is approximately equal to the suction pressure of the compressor 1 (point (g) of FIG. 18). Further, the refrigerant is leaked indoors, and a pressure of the refrigerant in the first indoor unit C is lowered to the atmospheric pressure PA eventually (point (e) in FIG. 18)

As described above, the air-conditioning apparatus 103 according to Embodiment 4 includes the number of first refrigerant shutoff valve 21, which is smaller than the number of indoor units X, in the first branch unit 9*b*. Therefore, cost reduction and simplification of control can be both achieved. Further, the first refrigerant shutoff valve 21 is provided to the first branch unit 9*b* in which the first indoor unit-side connecting pipes 6*a* of the indoor units X join together, and the indoor relay flow control valves 10*a* and the relay indoor flow control valves 10*b* are provided for each of the second indoor unit-side connecting pipes 7*a* of the indoor units X. Therefore, when the refrigerant is leaked indoors in any of the indoor units X, the refrigerant indoor leakage can be reduced as much as possible by closing the relay indoor flow control valves 10*b* provided to the second indoor unit-side connecting pipe 7*a* of the indoor unit X in which the leakage occurs and the first refrigerant shutoff valve 21 provided to the portion of the first branch unit 9*b* in which the first indoor unit-side connecting pipes 6*a* join together.

Further, when the refrigerant leakage detecting units 43 detect the leakage of the refrigerant in at least one of the plurality of indoor units X, the control unit 70 controls the flow switching unit 2 so that the outdoor heat exchanger 3 serves as the passage functioning as the condenser. Therefore, the refrigerant flowing out of the outdoor heat exchanger 3 turns into liquid refrigerant. The liquid refrigerant is more likely to stay inside the pipe than the gas refrigerant. Therefore, the amount of recovery of the refrigerant flowing through the refrigeration cycle can be increased.

Embodiment 5

Figure 19:
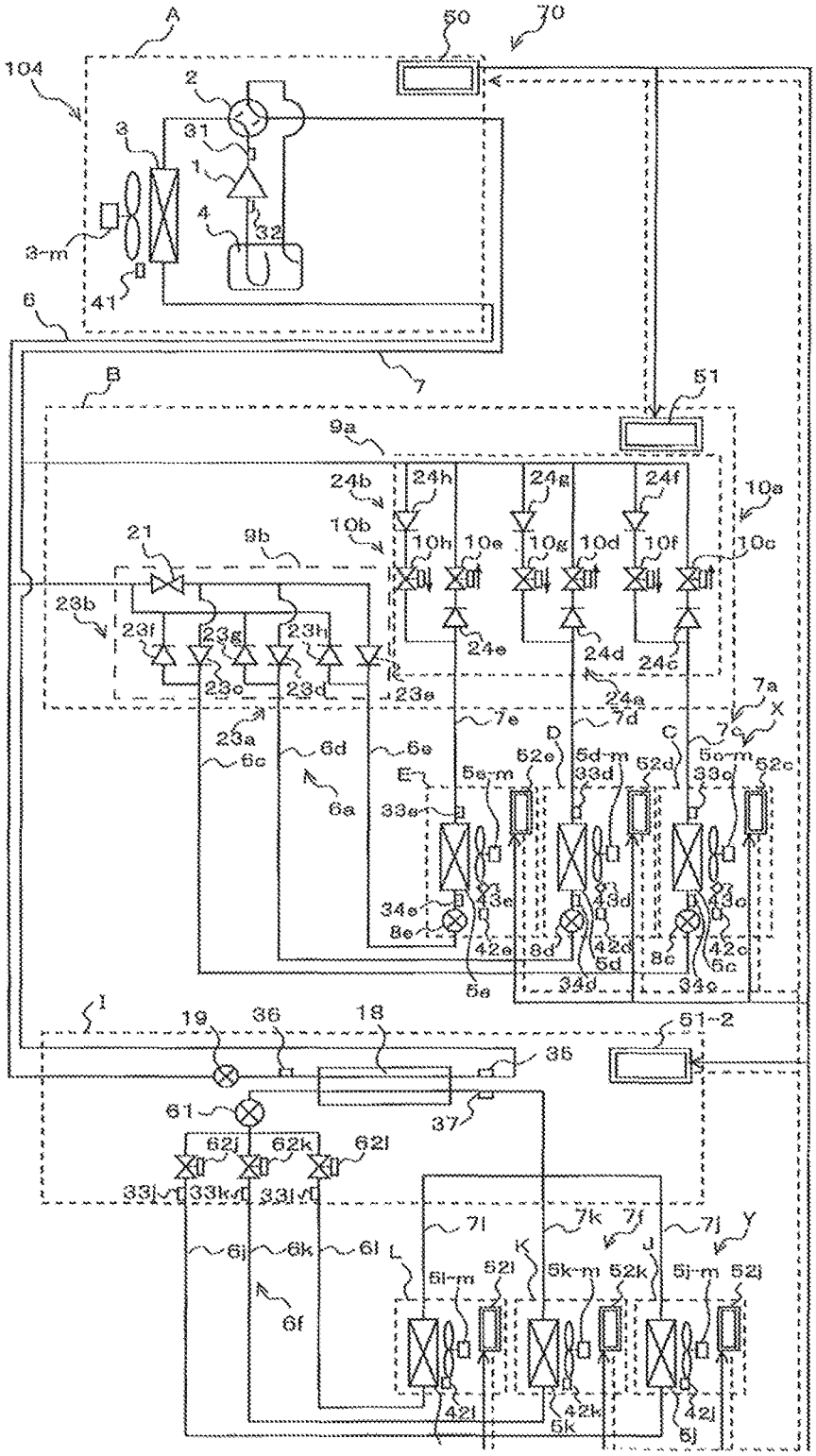
FIG. 19 is a circuit diagram for illustrating an air-conditioning apparatus 104 according to Embodiment 5 of the present invention.

Next, an air-conditioning apparatus 104 according to Embodiment 5 of the present invention is described. FIG. 19 is a circuit diagram for illustrating the air-conditioning apparatus 104 according to Embodiment 5 of the present invention. Embodiment 5 differs from Embodiment 2 in that a sub-relay unit I and a plurality of water-use indoor units Y are provided. The number of water-use indoor units Y is, for example, three. In Embodiment 5, the parts common to Embodiments 1, 2, 3, and 4 are denoted by the same reference symbols, and the description thereof is omitted, and differences from Embodiments 1, 2, 3, and 4 are mainly described.

(Sub-Relay Unit I)

The sub-relay unit I is connected in parallel to the relay unit B, and includes a water refrigerant heat exchanger 18, a sub-expansion unit 19, a pump 61, water flow switching valves 62, and a sub-relay control unit 51-2. The water refrigerant heat exchanger 18 is configured to allow heat exchange between the refrigerant supplied from the outdoor unit A and water flowing through the water-use indoor units Y. The sub-expansion unit 19 is configured to reduce the pressure of the refrigerant to expand the refrigerant. The pump 61 is configured to supply the water to the water-use indoor units Y. Further, the water flow switching valves 62 are configured to regulate the amount of water flowing through the water-use indoor units Y. The pump 61 is provided between the water refrigerant heat exchanger 18 and the water flow switching valves 62. The water flow switching valves 62 are respectively connected to first water-use indoor unit-side connecting pipes 6*f* connected to one ends of the water-use indoor unit Y. The water refrigerant heat exchanger 18 is connected to second water-use indoor unit-side connecting pipes 7*f* connected to other ends of the water-use indoor units Y.

The "first water-use indoor unit-side connecting pipes 6*f*" is a collective designation, and includes an eleventh water-use indoor unit-side connecting pipe 6*j* connected to the first water-use indoor unit J, a twelfth water-use indoor unit-side connecting pipe 6*k* connected to the second water-use indoor unit K, and a thirteenth water-use indoor unit-side connecting pipe 6*l* connected to the third water-use indoor unit L. Further, the "second water-use indoor unit-side connecting pipes 7*f*" is a collective designation, and includes a twenty-first water-use indoor unit-side connecting pipe 7*j* connected to the first water-use indoor unit J, a twenty-second water-use indoor unit-side connecting pipe 7*k* connected to the second water-use indoor unit K, and a twenty-third water-use indoor unit-side connecting pipe 7*l* connected to the third water-use indoor unit L.

Further, the "water flow switching valves 62" is a collective designation, and includes a first water flow switching valve 62*j* connected to the eleventh water-use indoor unit-side connecting pipe 6*j*, a second water flow switching valve 62*k* connected to the twelfth water-use indoor unit-side connecting pipe 6*k*, and a third water flow switching valve 62*l* connected to the thirteenth water-use indoor unit-side connecting pipe 6*l*.

Further, a first refrigerant-temperature detecting unit 35 and a second refrigerant-temperature detecting unit 36 are provided to both ends of the water refrigerant heat exchanger 18. Further, a first water-temperature detecting unit 37 is provided between the water refrigerant heat exchanger 18 and the water-use indoor units Y. Still further, second water-temperature detecting units 33*f* are provided to the first water-use indoor unit-side connecting pipe 6*f* in the vicinity of the water flow switching valves 62. The "second water-temperature detecting units 33*f*" is a collective designation, and includes a twenty-first water-temperature detecting unit 33*j* provided to the eleventh water-use indoor unit-side connecting pipe 6*j*, a twenty-second water-temperature detecting unit 33*k* provided to the twelfth water-use indoor unit-side connecting pipe 6*k*, and a twenty-third water-temperature detecting unit 33*l* provided to the thirteenth water-use indoor unit-side connecting pipe 6*l*.

The sub-relay control unit 51-2 is configured to control each of configurations of the air-conditioning apparatus 104 such as the water flow switching valves 62 based on temperature information detected by the first refrigerant-temperature detecting unit 35, the second refrigerant-temperature detecting unit 36, the first water-temperature detecting unit 37, and the second water-temperature detecting unit 33*f*. Although there is exemplified a case where the number of sub-relay unit I is one in Embodiment 5, a plurality of the sub-relay units I may be provided.

(Water-Use Indoor Units Y)

The water-use indoor units Y are installed at a location where the conditioned-air can be supplied to the space to be air-conditioned such as the indoor space, and are configured to supply cooling air or heating air to the space to be air-conditioned by cooling energy (cooling water) or heating energy (heating water) distributed from the outdoor unit A through the sub-relay unit I.

Each of the water-use indoor units Y includes a water heat exchanger 5*f* configured to allow heat exchange between the fluid and the water and a water-use indoor control unit 52*f*. The water heat exchangers 5*f* have one ends connected to the first water-use indoor unit-side connecting pipes 6*f* and other ends connected to the second water-use indoor unit-side connecting pipes 7*f*. The water heat exchangers 5*f* function as radiators during the heating operation and function as absorbers during the cooling operation. Then, the water heat exchangers 5*f* are configured to allow heat exchange between a fluid supplied from water-use air-sending devices 5*g*, for example, air and water to cool or heat the water.

The "water heat exchangers 5*f*" is a collective designation, and includes a first water heat exchanger 5*j* provided to the first water-use indoor unit J, a second water heat exchanger 5*k* provided to the second water-use indoor unit K, and a third water heat exchanger 5*l* provided to the third water-use indoor unit L. Further, the "water-use air-sending devices 5*g*" is a collective designation, and includes a first water-use air-sending device 5*jm* provided to the first water-use indoor unit J, a second water-use air-sending device 5*km* provided to the second water-use indoor unit K, and a third water-use air-sending device 5*lm* provided to the first water-use indoor unit L.

Water-use indoor-temperature detecting units 42*f* are respectively provided in the vicinity of the water heat exchangers 5*f*. The "water-use indoor-temperature detecting units 42*f*" is a collective designation, and includes a first water-use indoor-temperature detecting unit 42*j* provided in the vicinity of the first water heat exchanger 5*j*, a second water-use indoor-temperature detecting unit 42*k* provided in the vicinity of the second water heat exchanger 5*k*, and a third water-use indoor-temperature detecting unit 42*l* provided in the vicinity of the third water heat exchanger 5*l*. Further, the water-use indoor control units 52*f* are configured to control each of configurations of the air-conditioning apparatus 104 based on temperature information detected by the water-use indoor-temperature detecting units 42*f*. The water flowing through the water-use indoor units Y may be replaced by brine.

The "water-use indoor control units 52*f*" is a collective designation, and includes a first water-use indoor control unit 52*j* provided to the first water-use indoor unit J, a second water-use indoor control unit 52*k* provided to the second water-use indoor unit K, and a third water-use indoor control unit 52*l* provided to the third water-use indoor unit L.

Next, functions of the air-conditioning apparatus 104 according to Embodiment 5 are described. In Embodiment 5, a heat medium that transports the cooling energy or the heating energy from the sub-relay unit I to the water-use indoor units Y is water. Therefore, even when the water is leaked, danger is extremely low. By installing the air-conditioning apparatus 104 according to Embodiment 5 in a room in which the leakage of even an extremely small amount of the refrigerant is not allowed, risk of the leakage of the refrigerant can be avoided.

Embodiment 6

Figure 20:
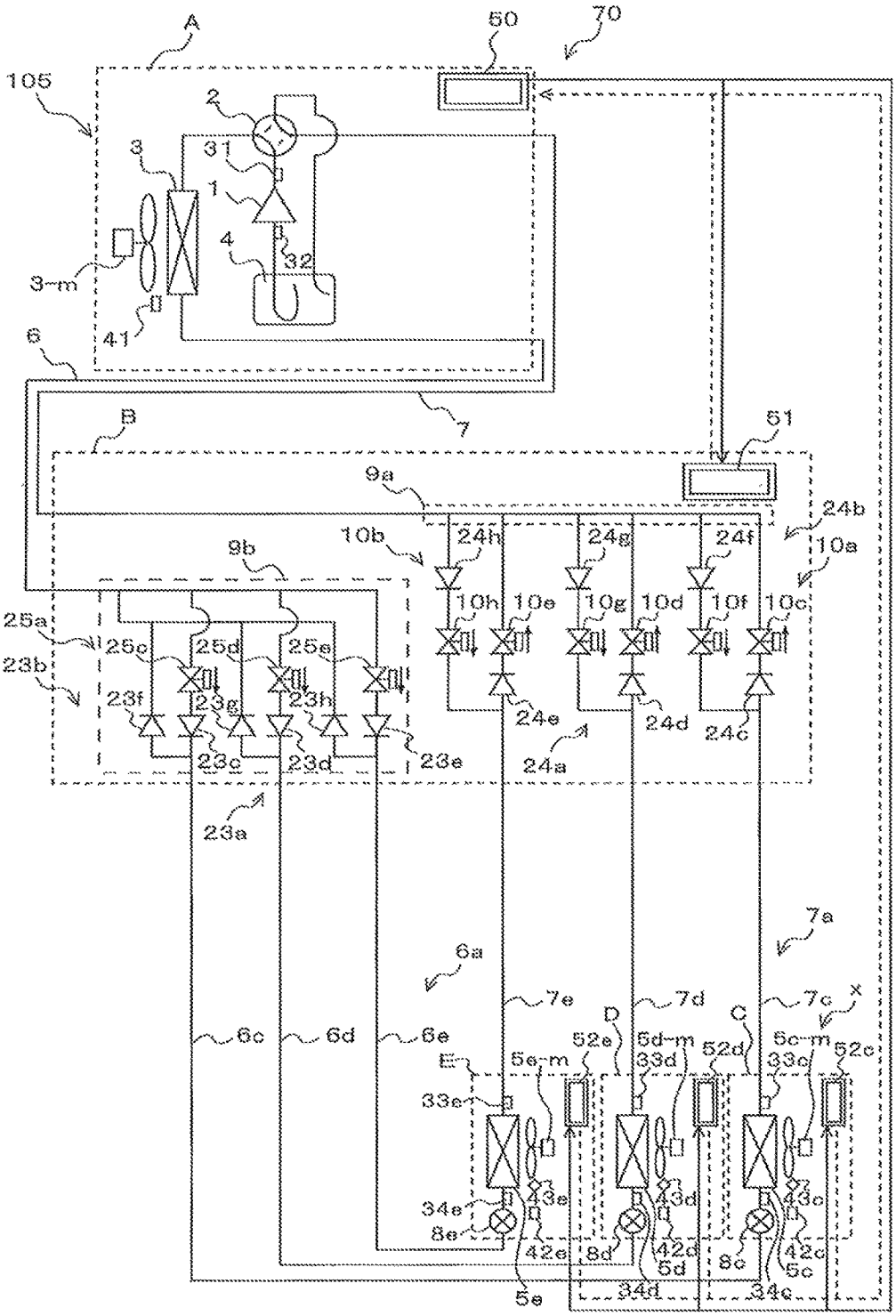
FIG. 20 is a circuit diagram for illustrating an air-conditioning apparatus 105 according to Embodiment 6 of the present invention.

Next, an air-conditioning apparatus 105 according to Embodiment 6 of the present invention is described. FIG. 20 is a circuit diagram for illustrating the air-conditioning apparatus 105 according to Embodiment 6 of the present invention. Embodiment 6 differs from the variation of Embodiment 2 in that the relay unit B includes liquid-side flow control valves 25 without including the first refrigerant shutoff valves 21. In Embodiment 6, the parts common to Embodiments 1, 2, 3, 4, and 5 are denoted by the same reference symbols, and the description thereof is omitted, and differences from Embodiments 1, 2, 3, 4, and 5 are mainly described.

As illustrated in FIG. 20, the first branch unit 9*b* includes the liquid-side flow control valves 25. The liquid-side flow control valves 25 are configured to control unidirectional flow of the refrigerant from the relay unit B toward the indoor units X, and are connected in parallel to the parallel check valves 23*b* in the first branch unit 9*b*. The liquid-side flow control valves 25 are, for example, solenoid valves. The liquid-side flow control valves 25 perform a normal opening and closing operation when the pressure of the refrigerant is higher on the side of the first branch unit 9*b* (distal end side of the arrows in FIG. 20) than on the side of the indoor units X (base end side of the arrows in FIG. 20).

Here, the "liquid-side flow control valves 25" is a collective designation, and includes a first liquid-side flow control valve 25*c* provided to the eleventh indoor unit-side connecting pipe 6*c*, a second liquid-side flow control valve 25*d* provided to the twelfth indoor unit-side connecting pipe 6*d*, and a third liquid-side flow control valve 25*e* provided to the thirteenth indoor unit-side connecting pipe 6*e*. Each of the liquid-side flow control valves 25 may have the same structure as that of each of the relay indoor flow control valves 10*b*.

In Embodiment 6, by closing the liquid-side flow control valves 25 connected to the indoor unit X in which the leakage of the refrigerant occurs, the flow of the refrigerant inside the refrigerant circuit, which passes through the indoor units X, can be shut off. For the other indoor units X, the normal operation is performed.

By providing the liquid-flow control valves 25 connected in series to the series check valves 23*a* in the first branch unit 9*b* of the first connecting pipe 6 (liquid-side pipe) even in the refrigerant circuits of Embodiments 1 to 5 described above, the same effects as those of Embodiment 6 can be achieved.

REFERENCE SIGNS LIST

1 compressor 2 flow switching unit 3 outdoor heat exchanger

3*m* outdoor air-sending device 4 accumulator 5 indoor heat exchanger

5*a* indoor air-sending device 5*c* first indoor heat exchanger 5*cm* first indoor air-sending device 5*d* second indoor heat exchanger 5*dm* second indoor air-sending device 5*e* third indoor heat exchanger 5*em* third indoor air-sending device 5*f* water heat exchanger 5*g* water-use air-sending device

5*j* first water heat exchanger 5*jm* first water-use air-sending device 5*k* second water heat exchanger 5*km* second water-use air-sending device 5*l* third water heat exchanger 5*lm* third water-use air-sending device 6 first connecting pipe 6*a* first indoor unit-side connecting pipe 6*c* eleventh indoor unit-side connecting pipe 6*d* twelfth indoor unit-side connecting pipe 6*e* thirteenth indoor unit-side connecting pipe 6*f* first water-use indoor unit-side connecting pipe 6*j* eleventh water-use indoor unit-side connecting pipe 6*k* twelfth water-use indoor unit-side connecting pipe 6*f* thirteenth water-use indoor unit-side connecting pipe 7 second connecting pipe 7*a* second indoor unit-side connecting pipe 7*c* twenty-first indoor unit-side connecting pipe 7*d* twenty-second indoor unit-side connecting pipe 7*e* twenty-third indoor unit-side connecting pipe 7*f* second water-use indoor unit-side connecting pipe 7*j* twenty-first water-use indoor unit-side connecting pipe 7*k* twenty-second water-use indoor unit-side connecting pipe 7*l* twenty-third water-use indoor unit-side connecting pipe 8 indoor expansion unit 8*c* first indoor expansion unit 8*d* second indoor expansion unit

8*e* third indoor expansion unit 9*a* second branch unit 9*b* first branch unit

9*c* third branch unit 9*d* fourth branch unit 10*a* indoor relay flow control valve 10*b* relay indoor flow control valve 10*c* first indoor relay flow control valve 10*d* second indoor relay flow control valve 10*e* third indoor relay flow control valve 10*f* first relay indoor flow control valve 10*g* second relay indoor flow control valve 10*h* third relay indoor flow control valve 11 third connecting pipe 12 first expansion unit 13 second expansion unit 14 first check valve

15 second check valve 16 third check valve 17 fourth check valve 18 water refrigerant heat exchanger 19 sub-expansion unit 20 outdoor expansion unit 21 first refrigerant shutoff valve 22 second refrigerant shutoff valve 22*c* twenty-first refrigerant shutoff valve 22*d* twenty-second refrigerant shutoff valve 22*e* twenty-third refrigerant shutoff valve 23*a* series check valve 23*b* parallel check valve 23*c* first series check valve 23*d* second series check valve 23*e* third series check valve 23*f* first parallel check valve 23*g* second parallel check valve 23*h* third parallel check valve

24*a* indoor relay check valve 24*b* relay indoor check valve 24*c* first indoor relay check valve 24*d* second indoor relay check valve 24*e* third indoor relay check valve 24*f* first relay indoor check valve 24*g* second relay indoor check valve 24*h* third relay indoor check valve 25 liquid-side flow control valve

25*c* first liquid-side flow control valve 25*d* second liquid-side flow control valve 25*e* third liquid-side flow control valve 31 discharge-pressure detecting unit 32 suction-pressure detecting unit 33 second indoor unit temperature detecting unit 33*c* twenty-first indoor unit temperature detecting unit 33*d* twenty-second indoor unit temperature detecting unit 33*e* twenty-third indoor unit temperature detecting unit 33*f* second water-temperature detecting unit

33*j* twenty-first water-temperature detecting unit 33*k* twenty-second water-temperature detecting unit 33*l* twenty-third water-temperature detecting unit 34 first indoor unit temperature detecting unit 34*c* eleventh indoor unit temperature detecting unit 34*d* twelfth indoor unit temperature detecting unit 34*e* thirteenth indoor unit temperature detecting unit 35 first refrigerant-temperature detecting unit 36 second refrigerant-temperature detecting unit 37 first water-temperature detecting unit 41 outdoor-temperature detecting unit 42 indoor-temperature detecting unit 42*c* first indoor-temperature detecting unit

42*d* second indoor-temperature detecting unit 42*e* third indoor-temperature detecting unit 42*f* water-use indoor-temperature detecting unit

42*j* first water-use indoor-temperature detecting unit 42*k* second water-use indoor-temperature detecting unit 42*l* third water-use indoor-temperature detecting unit 43 refrigerant leakage detecting unit 43*c* first refrigerant leakage detecting unit 43*d* second refrigerant leakage detecting unit 43*e* third refrigerant leakage detecting unit 50 outdoor control unit 51 relay control unit

51-2 sub-relay control unit 52 indoor control unit 52*c* first indoor control unit 52*d* second indoor control unit 52*e* third indoor control unit 52*f* water-use indoor control unit 52*j* first water-use indoor control unit 52*k* second water-use indoor control unit 52*l* third water-use indoor control unit 61 pump 62 water flow switching valve 62*j* first water flow switching valve 62*k* second water flow switching valve 62*l* third water flow switching valve 70 control unit 80 plunger 81 main valve 82 solenoid coil 100, 101, 101*a*, 102, 103, 104 air-conditioning apparatus A outdoor unit B relay unit C first indoor unit D second indoor unit E third indoor unit I sub-relay unit J first water-use indoor unit K second water-use indoor unit L third water-use indoor unit X indoor unit Y water-use indoor unit

The invention claimed is:

1. An air-conditioning apparatus, comprising:

an outdoor unit including a compressor and an outdoor heat exchanger;

a plurality of indoor units each including an indoor heat exchanger; and a relay unit configured to distribute refrigerant supplied from the outdoor unit to plurality of indoor units, the relay unit including:

a first branch unit in which liquid-side pipes connected to the plurality of indoor units join together; and a refrigerant shutoff valve configured to control bidirectional flow of the refrigerant, and provided to in the first branch unit, a number of the refrigerant shutoff valve being smaller than a number of the plurality of indoor units, the first branch unit including a path configured to allow the flow of the refrigerant from each of the plurality of indoor units to the relay unit and a path configured to allow the flow of the refrigerant from the relay unit to the each of plurality of indoor units, the refrigerant shutoff valve being provided in the path configured to allow the flow of the refrigerant from the relay unit to the each of plurality of indoor units upstream of a branch position at which the path branches to the plurality of indoor units, and the refrigerant shutoff valve being provided on the downstream of a joining point which joins the path configured to allow the flow of the refrigerant from the relay unit to the each of plurality of indoor units and the path configured to allow the flow of the refrigerant from the each of plurality of indoor units to the relay unit.

2. The air-conditioning apparatus of claim 1, wherein the outdoor unit further includes a flow switching valve configured to switch a direction of flow of the refrigerant, the air-conditioning apparatus further comprises;

a refrigerant leakage detecting sensor configured to detect leakage of the refrigerant; and a controller configured to, when the leakage of the refrigerant in at least one of the plurality of indoor units is detected by the refrigerant leakage detecting sensor, control the flow switching valve so that the outdoor heat exchanger serves as a passage functioning as a condenser.

3. The air-conditioning apparatus of claim 1, wherein the first branch unit includes a parallel check valve configured to allow the flow of the refrigerant from the each of plurality of indoor units to the relay unit, and arranged in parallel to the refrigerant shutoff valve, and a series check valve configured to allow the flow of the refrigerant from the relay unit to the each of plurality of indoor units, and arranged in series to the refrigerant shutoff valve.

4. The air-conditioning apparatus of claim 1, wherein the first branch unit includes a liquid-side flow control valve configured to allow the flow of the refrigerant flowing out of the relay unit, a parallel check valve configured to allow the flow of the refrigerant from the each of plurality of indoor units to the relay unit, and arranged in parallel to the refrigerant shutoff valve, and a series check valve configured to allow the flow of the refrigerant from the relay unit to the each of plurality of indoor units, and arranged in series to the refrigerant shutoff valve.

5. The air-conditioning apparatus of claim 4, further comprising:

a refrigerant leakage detecting sensor configured to detect leakage of the refrigerant; and a controller configured to, when the leakage of the refrigerant in at least one of the plurality of indoor units is detected by the refrigerant leakage detecting sensor, close the liquid-side flow control valve connected to the indoor unit in which the refrigerant is leaked.

6. The air-conditioning apparatus of claim 1, wherein the relay unit includes a second branch unit in which gas-side pipes connected to the plurality of indoor units are joined together.

7. The air-conditioning apparatus of claim 6, wherein the second branch unit includes a path configured to allow the flow of the refrigerant from each of the plurality of indoor units to the relay unit and a path configured to allow the flow of the refrigerant from the relay unit to the each of plurality of indoor units, and wherein the refrigerant shutoff valve is provided in the path configured to allow the flow of the refrigerant from the relay unit to the each of plurality of indoor units on upstream of a branch position at which the path branches to the plurality of indoor units.

8. The air-conditioning apparatus of claim 6, wherein the second branch unit includes an indoor relay check valve configured to allow the flow of the refrigerant from the each of plurality of indoor units to the relay unit, and arranged in parallel to the refrigerant shutoff valve, and a relay indoor check valve configured to allow the flow of the refrigerant from the relay unit to the each of plurality of indoor units, and arranged in series to the refrigerant shutoff valve.

9. The air-conditioning apparatus of claim 6, wherein the second branch unit includes an indoor relay flow control valve configured to control flow of the refrigerant in a direction of flowing out of the each of plurality of indoor units, and a relay indoor flow control valve configured to control the flow of the refrigerant in a direction of flowing into the each of plurality of indoor units in the second branch unit, and connected in parallel to the indoor relay flow control valve.

10. The air-conditioning apparatus of claim 9, wherein the second branch unit includes a third branch unit connected to a discharge side of the compressor and configured to split the refrigerant to a plurality of the relay indoor flow control valves, and a fourth branch unit connected to a suction side of the compressor, in which the refrigerant from the indoor relay flow control valve and a plurality of the indoor relay check valves configured to allow the flow of the refrigerant from the each of plurality of indoor units to the relay unit.

11. The air-conditioning apparatus of claim 9, further comprising:

a refrigerant leakage detecting sensor configured to detect leakage of the refrigerant; and a controller configured to, when the leakage of the refrigerant in at least one of the plurality of indoor units is detected by the refrigerant leakage detecting sensor, open the indoor relay flow control valve connected to the indoor unit into which the refrigerant is leaked, close the relay indoor flow control valve connected to the indoor unit into which the refrigerant is leaked, and close the refrigerant shutoff valve.

12. The air-conditioning apparatus of claim 1, further comprising:

a sub-relay unit connected in parallel to the relay unit, and includes a water refrigerant heat exchanger configured to allow heat exchange between water and the refrigerant; and a water-use indoor unit including a water heat exchanger configured to allow heat exchange between the water flowing out of the water refrigerant heat exchanger in the sub-relay unit and a fluid.

* * * * *